US010265952B2

(12) United States Patent
Shimono

(10) Patent No.: US 10,265,952 B2
(45) Date of Patent: Apr. 23, 2019

(54) LIQUID DISCHARGING APPARATUS AND METHOD OF DETECTING CAPABILITY OF EXCHANGING PRINT HEAD

(71) Applicant: SEIKO EPSON CORPORATION, Tokyo (JP)

(72) Inventor: Hiroaki Shimono, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/973,797

(22) Filed: May 8, 2018

(65) Prior Publication Data

US 2018/0345658 A1 Dec. 6, 2018

(30) Foreign Application Priority Data

May 30, 2017 (JP) ..... 2017-106249

(51) Int. Cl.
*B41J 2/14* (2006.01)
*B41J 2/045* (2006.01)
*B41J 25/34* (2006.01)

(52) U.S. Cl.
CPC ..... *B41J 2/0457* (2013.01); *B41J 2/04541* (2013.01); *B41J 2/04581* (2013.01); *B41J 2/14* (2013.01); *B41J 25/34* (2013.01); *B41J 2002/14491* (2013.01)

(58) Field of Classification Search
CPC .. B41J 2/0457; B41J 2/04541; B41J 2/04581; B41J 2/14; B41J 25/34; B41J 2002/14491
USPC ..... 347/9
See application file for complete search history.

(56) References Cited

U.S. PATENT DOCUMENTS 5,940,097 A 8/1999 Imai
2009/0002451 A1* 1/2009 Silverbrook ..... B41J 2/155 347/49
2015/0273822 A1* 10/2015 Teraji ..... B41J 2/04586 347/9

FOREIGN PATENT DOCUMENTS

JP 09-254388 A 9/1997
JP 10-329315 A 12/1998
JP 2013-091561 A 5/2013
JP 2013-244633 A 12/2013

* cited by examiner

*Primary Examiner* — Huan H Tran
*Assistant Examiner* — Alexander D Shenderov

(57) ABSTRACT

A liquid discharging apparatus capable of performing printing on a medium having a short-side width of A3 or greater, the apparatus including a head unit which includes an exchangeable print head including a discharge unit that discharges a liquid through driving of a drive element, a detection circuit which detects that exchanging of the print head is possible, and a wiring substrate which is provided with a connector and is electrically connected to the print head via the connector, a drive circuit which outputs a drive signal for driving the drive element, and a cable which is connected to the wiring substrate and transfers the drive signal to the print head.

11 Claims, 11 Drawing Sheets

FIG. 7
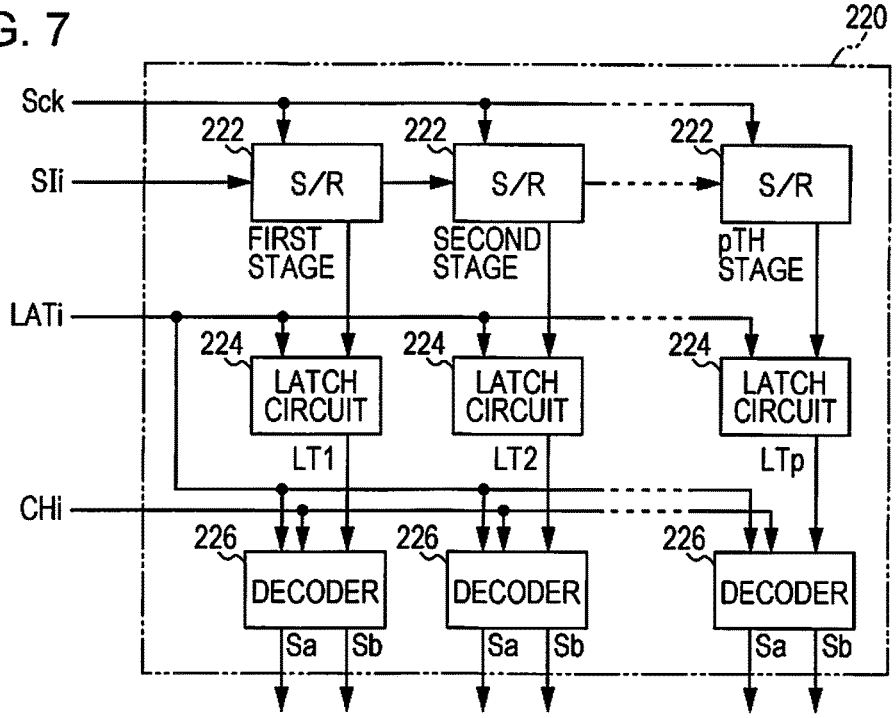
FIG. 8
| (SIH, SIL) | T1 | | T2 | |
|---|---|---|---|---|
| | Sa | Sb | Sa | Sb |
| (1, 1) [LARGE DOT] | H | L | H | L |
| (1, 0) [MEDIUM DOT] | H | L | L | H |
| (0, 1) [SMALL DOT] | L | L | L | H |
| (0, 0) [NON-RECORDNIG] | L | H | L | L |
FIG. 9
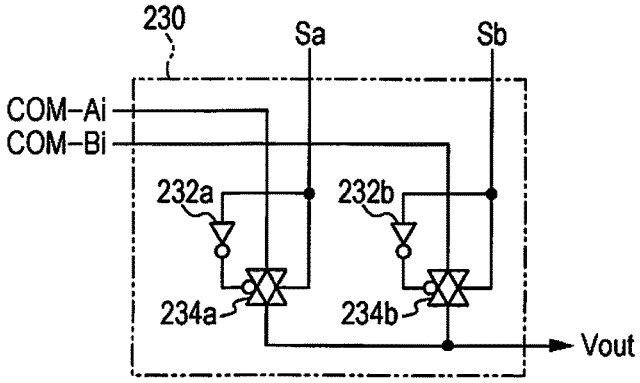

LIQUID DISCHARGING APPARATUS AND METHOD OF DETECTING CAPABILITY OF EXCHANGING PRINT HEAD

CROSS-REFERENCE TO RELATED APPLICATION

The entire disclosure of Japanese Patent Application No. 2017-106249, filed Mar. 30, 2017 is expressly incorporated by reference herein.

BACKGROUND

1. Technical Field

The present invention relates to a liquid discharging apparatus and a method of detecting that exchanging of a print head is possible.

2. Related Art

There is known an ink jet printer (a liquid discharging apparatus) which uses piezoelectric elements that discharges an ink to print images and text. The piezoelectric elements are provided to correspond to each of a plurality of nozzles in a head (the print head) and each is driven according to a drive signal. The head forms dots on a printing target (a medium) by discharging a predetermined amount of the ink (the liquid) at a predetermined timing from the nozzles according to the driving of the piezoelectric elements.

In such an ink jet printer, for example, there is known a configuration in which exchangeable heads are provided as a way to handle maintenance with respect to age degradation and malfunctioning that accompany usage over a long period. In the ink jet printer which is provided with exchangeable heads, there is demand for the capability to more reliably perform exchanging work of the heads and for the capability to easily perform the exchanging work of the heads.

JP-A-9-254388 discloses an ink jet printer which is provided with a head unit that can be attached and detached.

However, in the ink jet printer which is disclosed in JP-A-9-254388, a head which discharges a liquid and a drive circuit which outputs a drive signal for driving the head are included in the head unit which is exchanged. Therefore, even in a case in which it is sufficient to exchange only the head or the drive circuit in the exchanging of the head, it is necessary to exchange both the head and the drive circuit. Therefore, in the ink jet printer which is disclosed in JP-A-9-254388, the head unit to be exchanged is expensive. Since the head unit to be exchanged includes both the head and the drive circuit, the structure is complicated and there is a possibility that the ease of the exchanging work will be impaired. There is room for improvement in the ink jet printer which is disclosed in JP-A-9-254388 in order to more reliably perform the exchanging of the head unit.

SUMMARY

An advantage of some aspects of the invention is to provide, in a liquid discharging apparatus which is provided with an exchangeable print head, a liquid discharging apparatus in which it is possible to more reliably perform exchanging work of the print head and in which it is possible to easily perform the exchanging work of the print head, and a method of detecting that exchanging of the print head is possible.

The invention can be realized in the following aspects or application examples.

Application Example 1

According to this application example, there is provided a liquid discharging apparatus capable of performing printing on a medium having a short-side width of A3 or greater, the apparatus including a head unit which includes an exchangeable print head including a discharge unit that discharges a liquid through driving of a drive element, a detection circuit which detects that exchanging of the print head is possible, and a wiring substrate which is provided with a connector and is electrically connected to the print head via the connector, a drive circuit which outputs a drive signal for driving the drive element, and a cable which is connected to the wiring substrate and transfers the drive signal to the print head.

A board to board connector which connects a substrate to another substrate may be used for "the connector". A piezoelectric element or a heat generating element may be used for "the drive element", for example.

In the liquid discharging apparatus according to this application example, the exchangeable print head is provided on the head unit together with the detection circuit which detects that the exchanging of the print head is possible. Accordingly, the detection circuit is capable of detecting that the exchanging of the exchanging target print head is possible in the vicinity of the print head. Therefore, the detection circuit is capable of precisely detecting that the exchanging of the print head is possible. Accordingly, it is possible to more reliably perform the exchanging work of the print head.

In the liquid discharging apparatus according to this application example, by connecting the cable to the wiring substrate and connecting the wiring substrate and the print head to each other using the connector, the print head can be more easily attached and detached due to the connector which is provided on the wiring substrate regardless of the number, structure, and the like of the cables over which the drive signals are transferred. Accordingly, it is possible to easily perform the exchanging work of the print head.

Application Example 2

In the liquid discharging apparatus according to the application example, the detection circuit may be provided on the wiring substrate.

In the liquid discharging apparatus according to this application example, the detection circuit is provided on the wiring substrate which is provided with a connector capable of attaching and detaching with respect to the print head. Accordingly, the detection circuit is capable of detecting that the exchanging of the print head is possible in the vicinity of the connector which electrically connects the exchangeable print head to the wiring substrate. Therefore, it is possible to yet more precisely perform the detection. Accordingly, it is possible to more reliably perform the exchanging work of the print head.

In the liquid discharging apparatus according to this application example, the detection circuit is not provided on the exchanging target print head. Therefore, it is possible to reduce an increase in the number of components of the print head to be exchanged and to further reduce the complication of the configuration of the exchanging target print head.

Accordingly, the possibility that the ease of the exchanging work of the print head will be impaired is reduced.

Application Example 3

In the liquid discharging apparatus according to the application example, the cable may transfer a power voltage signal to the head unit, and the detection circuit may detect that the exchanging of the print head is possible, based on the power voltage signal.

A signal which is based on the power voltage which is used in the generation of the drive signal which is output by the drive circuit or the power voltage which is supplied to various configuration elements that are included in the print head may be used for "the power voltage signal".

In the liquid discharging apparatus according to this application example, the power voltage signal is transferred to the head unit which includes the print head and the wiring substrate via the cable. The detection circuit detects that the print head is exchangeable based on the power voltage signal which is transferred to the print head. For example, when the power voltage signal which is transferred by the cable and is supplied to the print head is less than or equal to a predetermined value, the detection circuit detects that the exchanging of the print head is possible, indicating that the power voltage (the power) which is supplied to the print head is less than or equal to the predetermined value. Accordingly, it is possible to reduce problems that are caused by a residual voltage (a charge) in the cable and the print head during the exchanging work of the print head. Accordingly, it is possible to more reliably perform the exchanging work of the print head.

Application Example 4

In the liquid discharging apparatus according to the application example, the cable may transfer a plurality of the power voltage signals to the head unit, and the detection circuit may detect that the exchanging of the print head is possible, based on a signal which is obtained by combining the plurality of power voltage signals.

A signal which is obtained by electrically connecting the wiring over which a plurality of power voltage signals, which is transferred by the cable, is transferred to one another or a signal which is obtained by electrically connecting the wiring over which the plurality of power voltage signals, which is transferred by the cable, is transferred to one another via circuit elements or the like may be used for "the signal which is obtained by combining the plurality of power voltage signals".

In the liquid discharging apparatus according to this application example, the plurality of power voltage signals is transferred to the head unit which includes the print head and the wiring substrate via the cable. The detection circuit detects that the print head is exchangeable based on a signal which is obtained by combining the plurality of power voltage signals that is input. For example, when a signal which is obtained by combining the plurality of power voltage signals which is input is less than or equal to a predetermined value, the detection circuit detects that the exchanging of the print head is possible, indicating that the plurality of power voltages (the power) which is supplied to the print head is less than or equal to the predetermined value. Accordingly, even in a case in which the plurality of power voltage signals is supplied to the print head, it is possible to reduce an increase in the scale of the detection circuit and to reduce problems that are caused by a residual voltage (a charge) in the cable and the print head during the exchanging work of the print head. Accordingly, even in the print head to which the plurality of power voltage signals is supplied, it is possible to reduce an increase in the circuit scale of the detection circuit and to more reliably perform the exchanging work of the print head.

Application Example 5

In the liquid discharging apparatus according to the application example, the cable may transfer a plurality of the power voltage signals to the head unit, and the detection circuit may detect that the exchanging of the print head is possible, based on the plurality of power voltage signals.

In the liquid discharging apparatus according to this application example, the plurality of power voltage signals is transferred to the head unit which includes the print head and the wiring substrate via the cable. At this time, a signal which is based on the plurality of power voltage signals is input to the detection circuit. The detection circuit detects that the print head is exchangeable based on the plurality of power voltage signals that is input. For example, when each of the plurality of power voltage signals which is input is less than or equal to a predetermined value, the detection circuit detects that the exchanging of the print head is possible, indicating that the plurality of power voltages (the power) which is supplied to the print head is less than or equal to the predetermined value. Accordingly, the detection circuit is capable of detecting that the exchanging of the print head is possible with even higher precision. Accordingly, it is possible to more reliably perform the exchanging work of the print head.

In the liquid discharging apparatus according to this application example, since it is possible to detect a signal which is based on the plurality of power voltage signals that is transferred to the print head, it is possible to adapt to the detection of connection faults during the attachment work of the print head.

Application Example 6

The liquid discharging apparatus according to the application example may further include a notification unit which performs notification of whether or not the exchanging of the print head is possible, based on a result that is detected by the detection circuit.

In the liquid discharging apparatus according to this application example, by providing the notification unit which performs notification of the fact that the detection circuit detects that the exchanging of the print head is possible, the exchanging worker is capable of ascertaining that the exchanging of the print head is possible. Accordingly, the exchanging work of the print head becomes [illegible] ble at a suitable timing and the ease of the exchanging work of the print head is further improved.

Application Example 7

In the liquid discharging apparatus according to the application example, the notification unit may include a light emitting element which is provided to be visually recognizable.

The term "visually recognizable" means that the exchanging worker is capable of recognizing the light emission or non-lighting (or dimming) of the light emitting element during the exchanging work of the print head. For example, a light emitting diode (an LED element) or an electroluminescence element (an EL element) may be used for "the light emitting element".

In the liquid discharging apparatus according to this application example, since the notification unit which notifies the exchanging worker of the fact that the exchanging of the print head is possible and is the lighting and non-lighting (or dimming) of a light emitting element, the notification unit is capable of visually notifying the exchanging worker of the fact that the exchanging of the print head is possible. Accordingly, the ease of the exchanging work of the print head is further improved.

Application Example 8

In the liquid discharging apparatus according to the application example, the light emitting element may be provided on the wiring substrate.

In the liquid discharging apparatus according to this application example, the light emitting element which is the notification unit is provided on the wiring substrate which is provided with a connector which is electrically connected to the print head to be exchanged. Ordinarily, when exchanging the print head, the exchanging worker visually inspects the vicinity of the print head to be exchanged and the connector which is connected to the print head and performs the exchanging work. Therefore, by providing the light emitting element on the wiring substrate which includes the connector that is viewed by the exchanging worker, it is possible to efficiently notify the exchanging worker of the fact that the exchanging of the print head is possible. Accordingly, the ease of the exchanging work of the print head is further improved.

In the liquid discharging apparatus according to this application example, the light emitting element is provided on the wiring substrate which is provided with a connector capable of attaching and detaching with respect to the print head. In other words, the light emitting element is not provided on the exchanging target print head. Therefore, it is possible to reduce an increase in the number of components of the print head to be exchanged and to further reduce the complication of the configuration of the exchanging target print head. Accordingly, the possibility that the ease of the exchanging work of the print head will be impaired is reduced.

Application Example 9

According to this application example, there is provided a method of detecting that exchanging of a print head is possible in a liquid discharging apparatus which performs printing on a medium having a short-side width of A3 or greater and which is provided with a head unit which includes the exchangeable print head including a discharge unit that discharges a liquid through driving of a drive element, a detection circuit, and a wiring substrate, a drive circuit which outputs a drive signal for driving the drive element, and a cable which transfers the drive signal, the method including a step of causing the detection unit to detect that the exchanging of the print head is possible.

In the method of detecting that the exchanging of the print head is possible according to this application example, in the liquid discharging apparatus, the exchangeable print head is provided on the head unit together with the detection circuit which detects that the exchanging of the print head is possible. Accordingly, the detection circuit is capable of detecting that the exchanging of the print head is possible in the vicinity of the print head. Therefore, the detection circuit is capable of precisely detecting that the exchanging of the print head is possible. Accordingly, due to the detection circuit which is provided on the head unit including a step of detecting that the exchanging of the print head is possible, it is possible to reduce the malfunctioning of the liquid discharging apparatus which accompanies the exchanging work of the print head.

In the method of detecting that the exchanging of the print head is possible according to this application example, the exchanging target print head and the cable which transfers the drive signal to the print head are connected to each other via the wiring substrate. Furthermore, the print head and the wiring substrate are connected using a connector. Therefore, the drive signal which is transferred by the cable is input to the print head via the wiring substrate and the connector which is provided on the wiring substrate. It is possible to easily attach and detach the print head and the cable which transfers the drive signal using the connector which is provided on the wiring substrate. In this manner, by connecting the cable to the wiring substrate and connecting the wiring substrate and the print head to each other using the connector, the print head can be more easily attached and detached due to the connector which is provided on the wiring substrate regardless of the number, structure, and the like of the cables over which the drive signals are transferred. Accordingly, it is possible to easily perform the exchanging work of the print head.

BRIEF DESCRIPTION OF THE DRAWINGS

The invention will be described with reference to the accompanying drawings, wherein like numbers reference like elements.

FIG. 7 is a diagram illustrating a configuration of a selection control unit.

FIG. 8 is a table illustrating decoded content of a decoder.

FIG. 9 is a diagram illustrating a configuration of a selection unit.

DESCRIPTION OF EXEMPLARY EMBODIMENTS

Hereinafter, a detailed description will be given of favorable embodiments of the invention using the drawings. The drawings which are used are for the convenience of explanation. The embodiments described hereinafter are not to be construed as inappropriately limiting the content of the invention. All of the configurations which are described hereinafter are not necessarily essential constituent elements of the invention.

1. First Embodiment

1.1 Outline of Liquid Discharging Apparatus

A printing apparatus that serves as an example of a liquid discharging apparatus according to the first embodiment is an ink jet printer which forms an ink dot group on a printing medium such as paper by discharging an ink according to image data which is supplied from an external host computer, and thus, prints an image (including characters, images, and the like) according to the image data.

Figure 1:
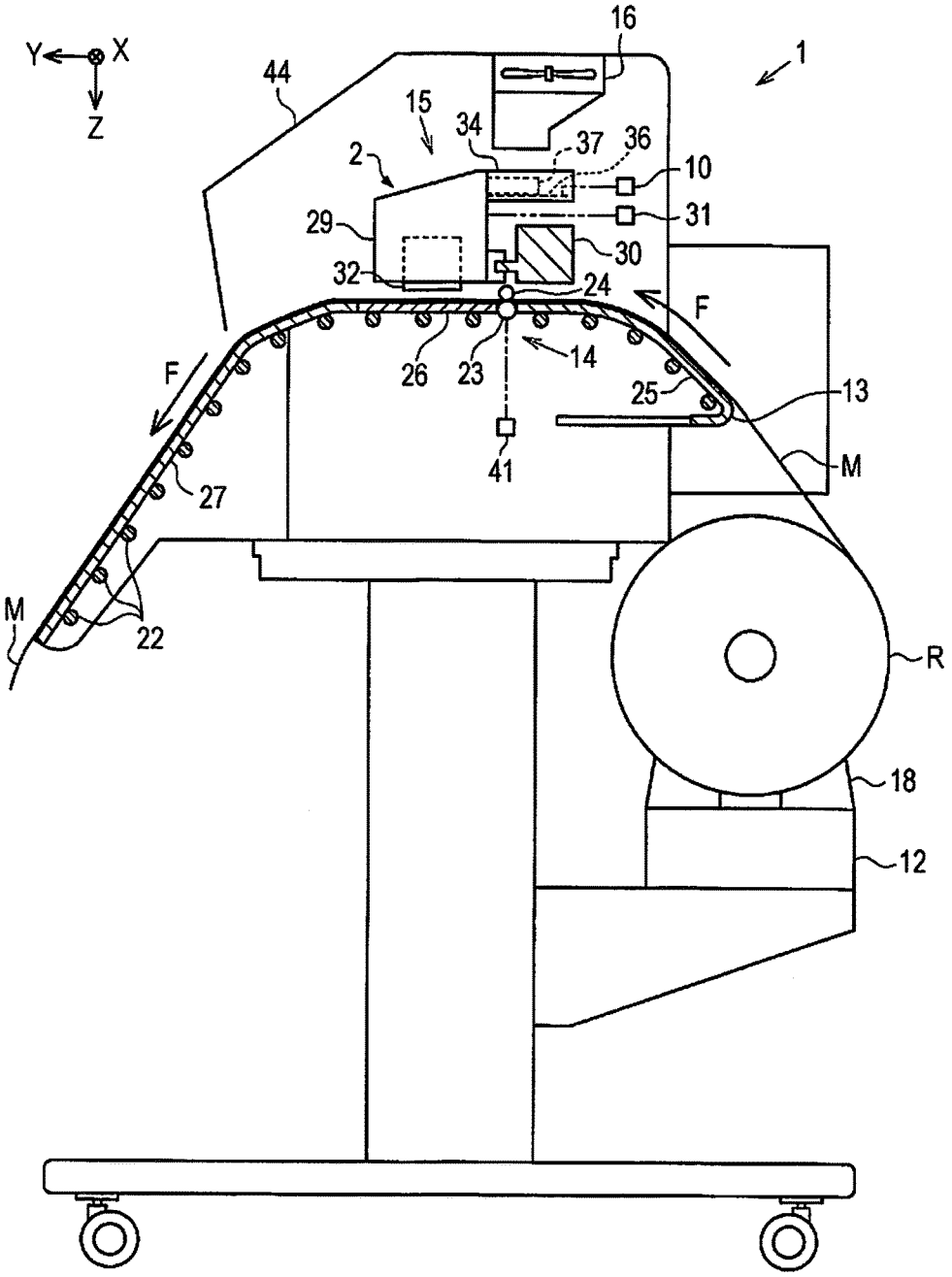
FIG. 1 is a lateral schematic view illustrating a configuration of a liquid discharging apparatus.
Figure 2:
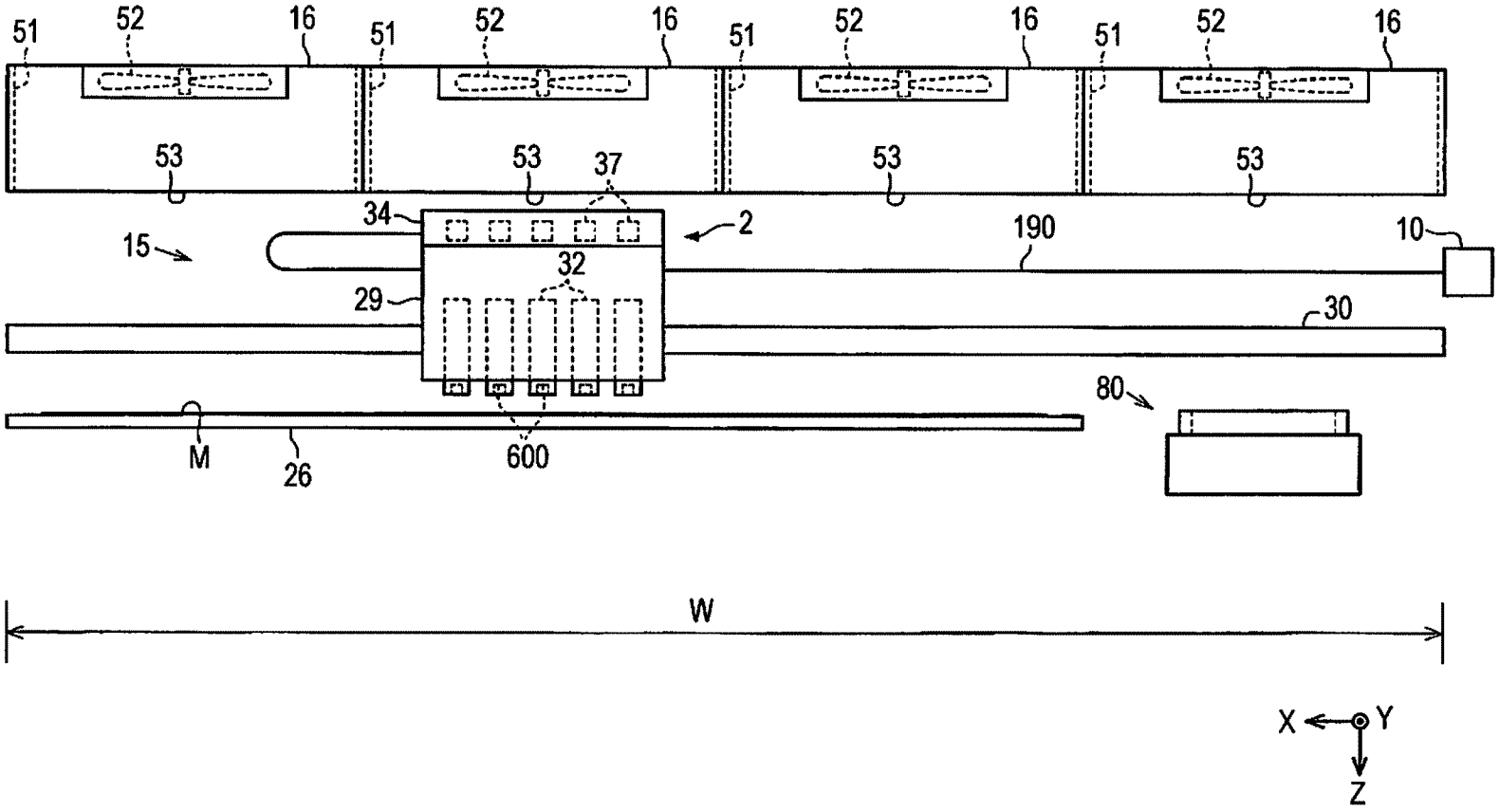
FIG. 2 is a front view illustrating an internal configuration of the liquid discharging apparatus.

FIG. 1 is a lateral schematic view illustrating a configuration of a liquid discharging apparatus 1. FIG. 2 is a front view illustrating an internal configuration of the liquid discharging apparatus 1. The liquid discharging apparatus 1 according to the first embodiment is an ink jet printer which is capable of performing printing on a medium (a printing medium) having a width of A3 short-side width (297 mm) or greater. In the first embodiment, the explanation is performed using a serial printing system ink jet printer in which both the medium (the printing medium) and a print head unit move to perform printing. However, a line head system ink jet printer which only transports the medium (the printing medium) to perform the printing may be used.

As illustrated in FIG. 1, the liquid discharging apparatus 1 is provided with a feed-out unit 12, a support portion 13, a transport unit 14, a printing unit 15, a blowing unit 16, and a control unit 10. The feed-out unit 12 feeds out a medium M, the support portion 13 supports the medium M, the transport unit 14 transports the medium M, the printing unit 15 performs printing on the medium M, the blowing unit 16 blows a gas toward the printing unit 15, and the control unit 10 controls these constituent elements of the liquid discharging apparatus 1.

In the following description, a width direction of the liquid discharging apparatus 1 (a direction perpendicular to the paper surface in FIG. 1) is "a first direction X", a depth direction of the liquid discharging apparatus 1 (a left-right direction of the paper surface in FIG. 1) is "a second direction Y", a height direction of the liquid discharging apparatus 1 (an up-down direction of the paper surface in FIG. 1) is "a third direction Z", and a direction in which the medium M is transported is "a transport direction F". The first direction X, the second direction Y, and the third direction Z are directions which intersect (are perpendicular to) each other and the transport direction F is a direction which intersects (is perpendicular to) the first direction X.

The feed-out unit 12 includes a holding member 18 which holds a roll body R on which the medium M is wound such that the roll body R is capable of rotating. The holding member 18 holds different types of the medium M and roll bodies R having different dimensions in the first direction X. In the feed-out unit 12, the medium M which is unwound from the roll body R is fed out toward the support portion 13 by causing the roll body R to rotate in one direction (in FIG. 1, the counterclockwise direction).

The support portion 13 is provided with, from upstream in the transport direction toward downstream in the transport direction, a first support portion 25, a second support portion 26, and a third support portion 27 which configure the transport path of the medium M. The first support portion 25 guides the medium M which is fed out from the feed-out unit 12 toward the second support portion 26, the second support portion 26 supports the medium M on which the printing is performed, and the third support portion 27 guides the printed medium M downstream in the transport direction.

A heating unit 22 which heats the first support portion 25, the second support portion 26, and the third support portion 27 is provided on the opposite side from the transport path side of the medium M in the first support portion 25, the second support portion 26, and the third support portion 27. The heating unit 22 heats the first support portion 25, the second support portion 26, and the third support portion 27 to indirectly heat the medium M which is supported by the first support portion 25, the second support portion 26, and the third support portion 27. The heating unit 22 is configured by an electrical heating wire (a heating wire), for example.

The transport unit 14 is provided with a transport roller 23, a driven roller 24, and a transport motor 41. The transport roller 23 applies a transporting force to the medium M, the driven roller 24 pressed the medium M against the transport roller 23, and the transport motor 41 drives the transport roller 23. The transport roller 23 and the driven roller 24 are rollers which use the first direction X as an axial direction.

The transport roller 23 is disposed vertically under the transport path of the medium M and the driven roller 24 is disposed vertically above the transport path of the medium M. The transport motor 41 is configured by a motor, a speed reducer, and the like, for example. In the transport unit 14, the medium M is transported in the transport direction F by causing the transport roller 23 to rotate in a state in which the medium M is pinched by the transport roller 23 and the driven roller 24.

As illustrated in FIGS. 1 and 2, the printing unit 15 is provided with a guide member 30 and a liquid discharging unit 2. The guide member 30 extends along the first direction X. The liquid discharging unit 2 is provided with a carriage 29, a plurality of (N) head units 32, and a plurality of (N) drive circuit units 37. The carriage 29 is supported by the guide member 30 to be capable of moving along the first direction X, the head units 32 are supported by the carriage 29 and discharge the ink onto the medium M, and the drive circuit units 37 are supported by the carriage 29 and drive each of the N head units 32. The liquid discharging unit 2 is provided with a relay substrate 36 and a heat radiating case 34. The relay substrate 36 relays various signals between the control unit 10 and the drive circuit units 37, and the heat radiating case 34 stores the drive circuit units 37 and the relay substrate 36.

The drive circuit unit 37 is electrically connected to the control unit 10 via a flexible flat cable 190 and the relay substrate 36.

The N head units 32 are supported on the bottom portion inside the carriage 29 in a state of being lined up equidistantly in the first direction X, and the bottom end portion of each of the head unit 32 protrudes from the bottom surface of the carriage 29 to the outside. A plurality of discharge units 600 from which the ink is discharged is provided on the bottom surface of each of the head units 32 such that the discharge units 600 are opened in the bottom surface in a state of being lined up in the second direction Y.

The printing unit 15 is provided with a carriage motor 31 and a maintenance unit 80. The carriage motor 31 moves the carriage 29 in the first direction X and the maintenance unit 80 performs the maintenance of the head units 32.

The maintenance unit 80 is provided to be adjacent to the second support portion 26 in the first direction X. The maintenance unit 80 executes a maintenance process for causing the discharging state of the ink in the discharge units 600 to recover to an ordinary state.

The blowing unit 16 includes a duct 51 and a blowing fan 52. The duct 51 communicates the inside and the outside of a housing 44 and the blowing fan 52 is provided inside the duct 51. The duct 51 includes a blowing port 53 which is opened to face a movement region W of the carriage 29. The blowing port 53 of the duct 51 is disposed to overlap the heat radiating case 34, which is disposed on the carriage 29, in the third direction Z.

A plurality of the blowing units 16 is provided vertically above the movement region W of the carriage 29 such that the blowing units 16 line up along the movement region W (in the first direction X). Therefore, the blowing units 16 are capable of blowing a gas (air) toward the entirety of the movement region W of the carriage 29. In other words, the blowing units 16 function as an air current generation unit which indirectly cools the drive circuit units 37 inside the heat radiating case 34 by being disposed along the movement path of the carriage 29 and blowing the gas toward the heat radiating case 34.

1.2 Electrical Configuration of Liquid Discharging Apparatus

Figure 3:
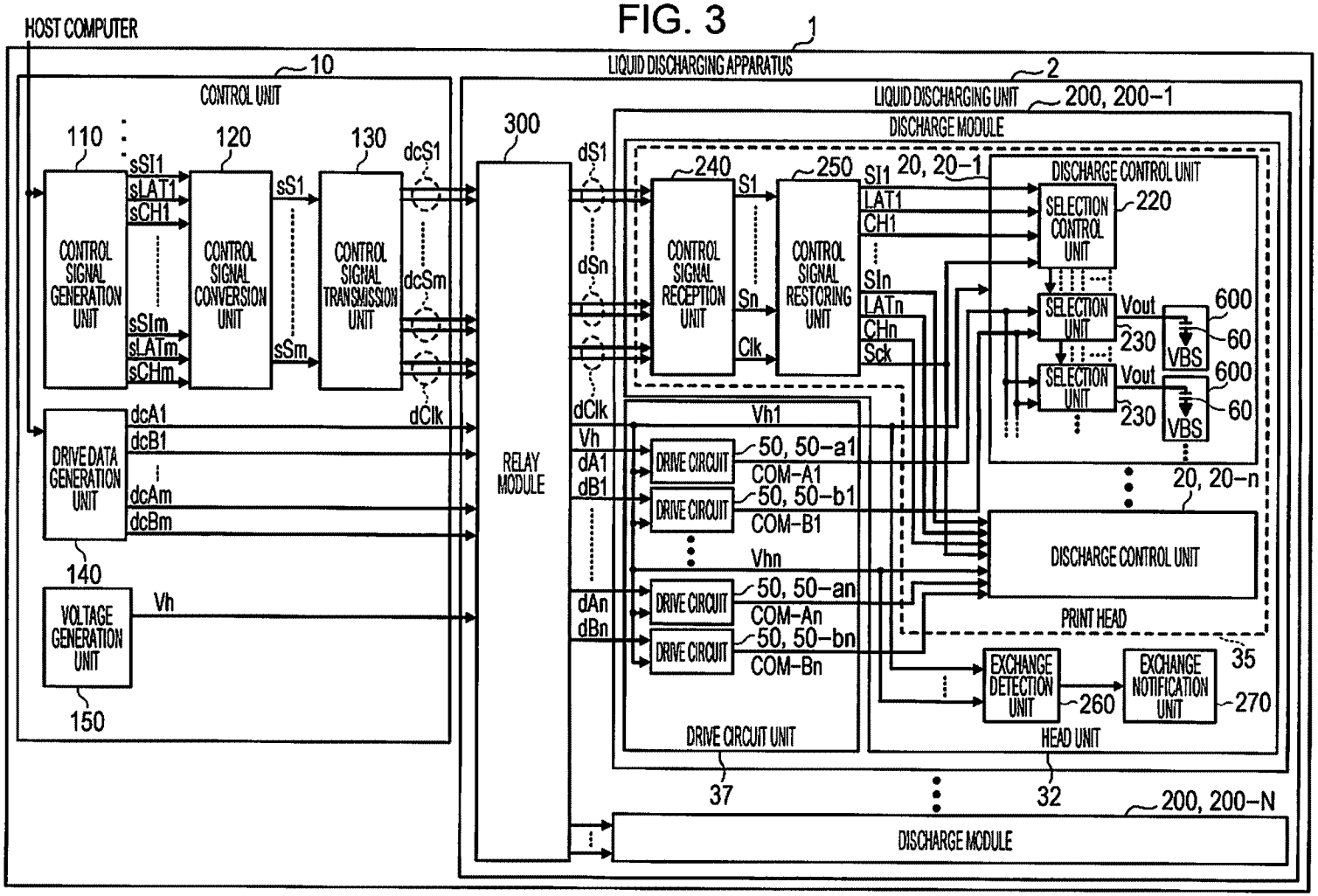
FIG. 3 is a block diagram illustrating an electrical configuration of the liquid discharging apparatus.

FIG. 3 is a block diagram illustrating an electrical configuration of the liquid discharging apparatus 1 of the first embodiment. As illustrated in FIG. 3, the liquid discharging apparatus 1 is provided with the liquid discharging unit 2 and the control unit 10 which controls the discharging of the liquid from the liquid discharging unit 2. The liquid discharging unit 2 and the control unit 10 are connected via the flexible flat cable 190 (refer to FIGS. 1 and 2).

The control unit 10 includes a control signal generation unit 110, a control signal conversion unit 120, a control signal transmission unit 130, a drive data generation unit 140, and a voltage generation unit 150.

The control signal generation unit 110 outputs various control signals and the like for controlling each part when various signals such as image data are supplied from the host computer.

Specifically, based on various signals from the host computer, the control signal generation unit 110 generates m (m≥1) original print data signals sSI1 to sSIm, m original latch signals sLAT1 to sLATm, and m original change signals sCH1 to sCHm as a plurality of types of original control signals which control the discharging of the liquid from the discharge units 600 and outputs the signals in parallel format to the control signal conversion unit 120. The various types of original control signal may not include a portion of these signals and other signals may be included.

The control signal conversion unit 120 converts (serializes) an original print data signal sSIi (where i is any number from 1 to m) which is output from the control signal generation unit 110, an original latch signal sLATi, and an original change signal sCHi into a single serial format original serial control signal sSi and outputs the original serial control signal sSi to the control signal transmission unit 130.

The control signal transmission unit 130 converts each of the m original serial control signals sS1 to sSm which are output from the control signal conversion unit 120 into differential signals dcS1 to dcSm, each of which is configured by two signals, and transmits the differential signals dcS1 to dcSm to the liquid discharging unit 2. The control signal transmission unit 130 generates a differential clock signal dClk which is used in high-speed serial data transfer of the differential signals dcS1 to dcSm and transmits the differential clock signal dClk to the liquid discharging unit 2. For example, the control signal transmission unit 130 generates the differential signals dcS1 to dcSm and the differential clock signal dClk of a low voltage differential signaling (LVDS) transfer system and transmits the generated signals to the liquid discharging unit 2. Since the amplitude of the differential signals of the LVDS transfer system is approximately 350 mV, it is possible to realize a high-speed data transfer. The control signal transmission unit 130 may be configured to generate the differential signals dcS1 to dcSm and the differential clock signal dClk of various transfer systems other than LVDS such as low voltage positive emitter coupled logic (LVPECL) or current mode logic (CML) and transmit the generated signals to the liquid discharging unit 2.

The drive data generation unit 140 generates 2 m items of drive data dcA1 and dcAm and dcB1 to dcBm based on various signals from the host computer and transmits the data to the liquid discharging unit 2. The drive data dcA1 and dcAm and dcB1 to dcBm is digital data which serves as the basis of the drive signals which drive n discharge control units 20 (20-1 to **20-*n*) which are provided in a plurality of (in the first embodiment, N) discharge modules 200 of the liquid discharging unit 2. In the first embodiment, the drive data dcA1 to dcAm and dcB1 to dcBm is digital data which is obtained by subjecting the waveforms of the drive signals (drive waveforms) to analog/digital conversion. However, the drive data dcA1 to dcAm and dcB1** to dcBm may be digital data indicating a difference with respect to the nearest item of drive data, and may be digital data which defines a correspondence relationship between the length of each zone in which the slope of the drive waveform is fixed and each slope.

The voltage generation unit 150 generates a voltage signal Vh (for example 42 V) (an example of "a power voltage signal") which is used by the liquid discharging unit 2 based on the power voltage which is input to the liquid discharging apparatus 1 and outputs the voltage signal Vh to the liquid discharging unit 2. The voltage generation unit 150 may perform the generation of various voltage signals which are used by the control unit 10.

In addition to the processes which are described above, the control unit 10 ascertains the scanning position (the current position) of the carriage 29 (the liquid discharging unit 2) and performs a process of driving the carriage motor 31 based on the scanning position of the carriage 29. Accordingly, the movement of the carriage 29 in the first direction X is controlled. The control unit 10 performs a process of driving the transport motor 41. Accordingly, the movement of the medium M in the transport direction F is controlled.

The control unit 10 executes a maintenance process for causing the maintenance unit 80 to recover the discharging state of the ink in the discharge units 600 to recover to an ordinary state. The maintenance unit 80 may include a cleaning mechanism for performing, as a maintenance process, a cleaning process (a pumping process) of sucking ink, bubbles, and the like which have increased in viscosity inside the discharge units 600 using a tube pump (not illustrated). The maintenance unit 80 may include a wiping mechanism for performing, as a maintenance process, a wiping process of wiping off foreign matter such as paper dust which adheres to the vicinity of the nozzles of the discharge units 600 using a wiper member.

The liquid discharging unit 2 is provided with a plurality of (N) discharge modules 200 (200-1 to 200-N) and a relay module 300. The electrical configuration of the N discharge modules 200 (200-1 to 200-N) is the same.

Signals from the control unit 10 including the differential signals dcS1 to dcSm, the differential clock signal dClk, the voltage signal Vh, and the drive data dcA1 to dcAm and dcB1 to dcBm are input to the relay module 300. The relay module 300 relays and splits the plurality of signals which are input and outputs the differential signals dS1 to dSn, the differential clock signal dClk, the voltage signal Vh, and drive data dA1 to dAn and dB1 to dBn to each of the plurality of (N) discharge modules 200 (200-1 to 200-N).

Here, the differential signal dSj (where j is any number from 1 to n) which is output from the relay module 300 may be the differential signal dcSi (where i is any number from 1 to m) which is input to the relay module 300 in an unaltered state, and the differential signal dcSi (where i is any number from 1 to m) which is input to the relay module 300 may be a signal which is subjected to signal processing by the relay module 300.

The drive data dAj and dBj (where j is any number from 1 to n) which is output from the relay module 300 may be the drive data dcAi and dcBi (where i is any number from 1 to m) which is input to the relay module 300 in an unaltered state, and the drive data dcAi and dcBi (where i is any number from 1 to m) which is input to the relay module 300 may be a signal which is subjected to signal processing by the relay module 300.

The N discharge modules 200 (200-1 to 200-N) are each provided with the drive circuit unit 37 (refer to FIGS. 1 and 2) and the head unit 32 (refer to FIGS. 1 and 2).

The drive data dA1 to dAn and dB1 to dBn and the voltage signal Vh are input to the drive circuit unit 37. The voltage signal Vh is divided by the drive circuit unit 37 and input to each of 2n drive circuits 50 (50-*a*1 to 50-*an* and 50-*b*1 to 50-*bn*). The drive signals COM-A1 to COM-An and COM-B1 to COM-Bn are output based on the drive data dA1 to dAn and dB1 to dBn and the voltage signal Vh. Several of the voltage signals Vh which are divided by the drive circuit unit 37 are output from the drive circuit unit 37 without being input to the 2n drive circuits 50 (50-*a*1 to 50-*an* and 50-*b*1 to 50-*bn*). The voltage signal Vh which is output from the drive circuit unit 37 is input to the head unit 32.

Here, the n drive circuits 50-*a*1 to 50-*an* among the 2n drive circuits 50 (50-*a*1 to 50-*an* and 50-*b*1 to 50-*bn*) generate the drive signals COM-A1 to COM-An, respectively, which drive a plurality of piezoelectric elements 60 which is included inside each of the discharge control units 20-1 to 20-*n* based on the drive data dA1 to dAn and the voltage signal Vh which are output from the relay module 300. Similarly, the other n drive circuits 50-*b*1 to 50-*bn* generate the drive signals COM-B1 to COM-Bn, respectively, which drive the plurality of piezoelectric elements 60 which is included inside each of the discharge control units 20-1 to 20-*n* based on the drive data dB1 to dBn and the voltage signal Vh which are output from the relay module 300.

For example, if items of the drive data dA1 to dAn and dB1 to dBn are items of digital data obtained by subjecting the waveforms of the drive signals COM-A1 to COM-An and COM-B1 to COM-Bn to analog/digital conversion, respectively, the drive circuits 50-*a*1 to 50-*an* and 50-*b*1 to 50-*bn* subject the items of the drive data dA1 to dAn and dB1 to dBn to digital/analog conversion and subsequently subject the voltage level which is based on the voltage signal Vh to class D amplification to generate the drive signals COM-A1 to COM-An and COM-B1 to COM-Bn.

For example, if items of the drive data dA1 to dAn and dB1 to dBn are items of digital data which define the correlation relationship between the length of each zone in which the slope of the waveform is fixed and each slope in the corresponding waveforms of the drive signals COM-A1 to COM-An and COM-B1 to COM-Bn, the drive circuits 50-*a*1 to 50-*an* and 50-*b*1 to 50-*bn* generate analog signals which satisfy the correlation relationship between the length of each zone which is defined by the drive data dA1 to dAn and dB1 to dBn and the slopes and subsequently subject the voltage level which is based on the voltage signal Vh to class D amplification to generate the drive signals COM-A1 to COM-An and COM-B1 to COM-Bn.

In this manner, the items of the drive data dA1 to dAn and dB1 to dBn are items of data which define the waveforms of the drive signals COM-A1 to COM-An and COM-B1 to COM-Bn, respectively. The 2n drive circuits 50 (50-*a*1 to 50-*an* and 50-*b*1 to 50-*bn*) generate the drive signals COM-A1 to COM-An and COM-B1 to COM-Bn by amplifying the waveforms which are defined by the drive data dA1 to dAn and dB1 to dBn to the voltage levels which are based on the voltage signal Vh. The 2n drive circuits 50 (50-*a*1 to 50-*an* and 50-*b*1 to 50-*bn*) may differ in only the data to be input and the drive signals to be output and may have the same circuit configuration.

The head unit 32 includes the n discharge control units 20 (20-1 to 20-*n*), a control signal reception unit 240, a control signal restoring unit 250, an exchange detection unit 260, and an exchange notification unit 270. The head unit 32 operates using voltage signals Vh1 to Vhn as power voltages. The head unit 32 discharges the liquid from the discharge units 600 by driving the plurality of piezoelectric elements 60 (an example of "a drive element") which are included in the discharge control units 20 based on the drive signals COM-A1 to COM-An and COM-B1 to COM-Bn which are input from the drive circuit units 37 and differential signals dS1 to dSn and the differential clock signal dClk which are input from the relay module 300.

The control signal reception unit 240 receives the differential signals dS1 to dSn of the LVDS transfer system which are output from the relay module 300, subjects each of the received differential signals dS1 to dSn to differential amplification, converts the results to serial control signals S1 to Sn, and outputs the converted serial control signals S1 to Sn to the control signal restoring unit 250. The control signal reception unit 240 receives the differential clock signal dClk of the LVDS transfer system which is transmitted from the relay module 300, subjects the received differential clock signal dClk to differential amplification, converts the result to a clock signal Clk, and outputs the converted clock signal Clk to the control signal restoring unit 250. The control signal reception unit 240 may receive the differential signals dS1 to dSn and the differential clock signal dClk of various high-speed transfer systems other than LVDS such as LVPECL and CML.

Based on the serial control signals S1 to Sn which are converted by the control signal reception unit 240, the control signal restoring unit 250 generates a clock signal Sck, n print data signals SI1 to SIn, n latch signals LAT1 to LATn, and n change signals CH1 to CHn as the plurality of types of control signal which control the discharging of the liquid from the discharge units 600. In detail, the control signal restoring unit 250 generates a print data signal SIj, a latch signal LATj, and a change signal CHj and outputs the signals to a discharge control unit 20-*j* by restoring (deserializing) the original print data signal sSIi (where i is any number from 1 to m), the original latch signal sLATi, and the original change signal sCHi which are included in a serial control signal Sj (where j is any number from 1 to n) which is output from the control signal reception unit 240. The control signal restoring unit 250 performs a predetermined process (for example, a process of dividing the clock signal Clk at a predetermined division ratio) on the clock signal Clk which is output from the control signal reception unit 240, generates the print data signals SI1 to SIn, the latch signals LAT1 to LATn, the change signals CH1 to CHn, and the synchronized clock signal Sck, and outputs the signals to the n discharge control units 20 (20-1 to 20-*n*).

The n discharge control units 20 (20-1 to 20-*n*) have the same configuration and each includes a selection control unit 220, p selection units 230, and p discharge units 600.

The selection control unit 220 instructs which of the drive signals COM-Ai and COM-Bi is to be selected with respect to each of the selection units 230 (or whether to not select any) using the clock signal Sck, the print data signal SIi, the latch signal LATi, and the change signal CHi which are output from the control signal restoring unit 250.

Each of the selection units 230 selects the drive signal COM-Ai or COM-Bi according to the instruction of the selection control unit 220 and outputs the signal to the corresponding discharge unit 600 as the drive signal Vout. The drive signal Vout is applied to one end of the piezoelectric element 60 which is included in the discharge unit 600. A reference voltage signal VBS is supplied in common to the other ends of all of the piezoelectric elements 60. The piezoelectric elements 60 are provided corresponding to each of the discharge units 600 and are displaced by the drive signals Vout (the drive signal COM-Ai and COM-Bi) being applied. The piezoelectric elements 60 are displaced to discharge the liquid (the ink) according to the potential differences between the drive signals Vout (the drive signals COM-Ai and COM-Bi) and the reference voltage signal VBS. In this manner, the drive signals COM-Ai and COM-Bi are signals for driving each of the discharge units 600 to discharge the liquid.

Since the drive signals COM-A1 to COM-An and COM-B1 to COM-Bn are signals which drive the discharge units 600 based on the voltage signal Vh, the signals are high voltage (several tens of volts) signals. Therefore, it is preferable that, as a signal for selecting the drive signal COM-Ai or COM-Bi, a signal based on the voltage signal Vh (the voltage signals Vhf to Vhn) be input to the discharge control unit 20 (20-1 to 20-*n*) containing the selection units 230.

Although details will be described later, in the first embodiment, an exchangeable print head 35 (refer to FIGS. 11 and 12) is configured by the control signal reception unit 240, the control signal restoring unit 250, and the plurality of discharge control units 20 (20-1 to 20-*n*). At this time, the control signal reception unit 240 and the control signal restoring unit 250 may be configured on a wiring substrate 33 which is connected to the print head 35, for example, but it is preferable that the control signal reception unit 240 and the control signal restoring unit 250 be configured on the print head 35. Due to the control signal reception unit 240 and the control signal restoring unit 250 being configured on the print head 35, the plurality of control signals that are input to the selection control unit 220 are input as the differential signals dS1 to dSn and the differential clock signal dClk. Therefore, the plurality of control signals that are input to the print head 35 are not easily influenced by common mode noise, and thus, it is possible to improve the discharge precision of the liquid discharging apparatus 1.

The voltage signals Vh1 to Vhn are input to the exchange detection unit 260 (an example of "a detection circuit"). The exchange detection unit 260 performs the detection of whether exchanging of the print head 35 is possible, based on the voltage signals Vh1 to Vhn. In the first embodiment, the exchange detection unit 260 performs the detection of whether exchanging of the print head 35 is possible, based on the voltage signals Vhf to Vhn. However, for example, the exchange detection unit 260 may perform the detection of whether exchanging of the print head 35 is possible, based on the drive signals COM-A1 to COM-An and COM-B1 to COM-Bn.

The exchange notification unit 270 functions as a notification unit for notifying an exchanging worker, for example, of the fact that the exchanging of the print head 35 is possible when the exchange detection unit 260 detects that the exchanging of the print head 35 is possible. The exchange notification unit 270 may notify the exchanging worker of the fact that the exchanging of the print head 35 is possible visually by using a light emitting element such as an LED element or an EL element, for example, and may notify the exchanging worker of the fact that the exchanging of the print head 35 is possible audibly by using a buzzer, speech, or the like. Furthermore, for example, the exchange notification unit 270 may be provided with a liquid crystal panel or the like and notify the exchanging worker of the fact that the exchanging of the print head 35 is possible using characters, symbols, or the like.

In the first embodiment, although the exchange notification unit 270 is included in the head unit 32, any configuration may be adopted in which it is possible to notify the exchanging worker of the fact that the exchanging of the print head 35 is possible. Therefore, for example, when the exchange notification unit 270 is configured using a light emitting element, the exchange notification unit 270 may be provided at a position which is visually recognizable to the exchanging worker, for example, the exchange notification unit 270 may be provided on the flexible flat cable 190 or may be provided somewhere on the housing of the liquid discharging apparatus 1.

A detailed description will be given later of the exchange detection unit 260 and the exchange notification unit 270.

1.3 Configuration of Discharge Unit

Figure 4:
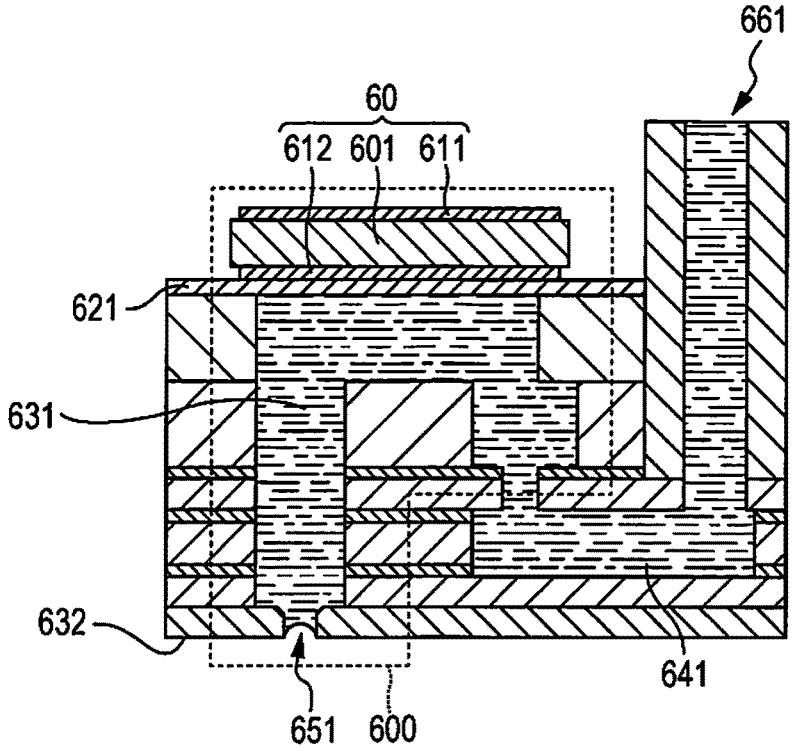
FIG. 4 is a view illustrating a configuration of a discharge unit.

FIG. 4 is a view illustrating the schematic configuration corresponding to a single discharge unit 600 of the discharge control unit 20. As illustrated in FIG. 4, the discharge control unit 20 includes the discharge unit 600 and a reservoir 641.

The reservoir 641 is provided for every color of ink, and the ink is introduced to the reservoir 641 from a supply port 661. The ink may be supplied to the supply port 661 from an ink cartridge which is mounted on the liquid discharging unit 2, and may be supplied to the supply port 661 via an ink tube from an ink tank which is attached to the main body side to be independent of the liquid discharging unit 2.

The discharge unit 600 includes the piezoelectric element 60, a diaphragm 621, a cavity (a pressure chamber) 631, and a nozzle 651. Among these, the diaphragm 621 is displaced (subjected to bending vibration) by the piezoelectric element 60 which is provided on the top surface in FIG. 4 and functions as a diaphragm which expands and contracts the internal volume of the cavity 631 which is filled with the ink. The nozzle 651 is an open hole portion which is provided in a nozzle plate 632 and communicates with the cavity 631.

The inner portion of the cavity 631 is filled with a liquid (for example, the ink) and the internal volume changes due to the displacement of the piezoelectric element 60. The nozzle 651 communicates with the cavity 631 and discharges the liquid inside the cavity 631 as droplets according to a change in the internal volume of the cavity 631.

The piezoelectric element 60 which is illustrated in FIG. 4 has a structure in which a piezoelectric body 601 is interposed between a pair of electrodes 611 and 612. In the piezoelectric body 601 of this structure, corresponding to a voltage that is applied by the electrodes 611 and 612, in FIG. 4, the central portion of the piezoelectric body 601 flexes in the upward or downward direction in relation to both end portions thereof together with the electrodes 611 and 612 and the diaphragm 621. Specifically, the piezoelectric element 60 is configured such that when the voltage of the drive signal Vout becomes high, the piezoelectric element 60 flexes in the upward direction, whereas when the voltage of the drive signal Vout becomes low, the piezoelectric element 60 flexes in the downward direction. In this configuration, if the piezoelectric element 60 flexes in the upward direction, since the internal volume of the cavity 631 expands, the ink is drawn in from the reservoir 641. However, if the piezoelectric element 60 flexes in the downward direction, since the internal volume of the cavity 631 contracts, the ink is discharged from the nozzle 651 depending on the degree of the contraction.

The piezoelectric element 60 is not limited to the depicted structure and may have a form which is capable of discharging the liquid such as the ink by causing the piezoelectric element 60 to deform. The piezoelectric element 60 is not limited to bending vibration and may be configured to use so-called longitudinal vibration.

The piezoelectric element 60 is provided corresponding to the cavity 631 and the nozzle 651 in the discharge control unit 20 and is also provided corresponding to the selection unit 230. Therefore, the set of the piezoelectric element 60, the cavity 631, the nozzle 651, and the selection unit 230 is provided for every nozzle 651.

1.4 Configuration of Drive Signal

For the method of forming dots on the medium M, in addition to a method (a first method) of discharging a single ink droplet to form a single dot, with the assumption that is it possible to discharge two or more ink droplets in a unit period, there are a method (a second method) of causing one or more ink droplets that are discharged in a unit period to land and combining the one or more ink landed droplets to form a single dot, and a method (a third method) of forming two or more dots without combining the two or more ink droplets.

In the first embodiment, according to the second method, four-level gradation of "large dot", "medium dot", "small dot", and "non-recording (no dot)" is expressed by discharging the ink a maximum of two times for a single dot. In order to express the four-level gradation, in the first embodiment, in the discharge control unit 20-*i* (where i is any number from 1 to n), two types of the drive signal COM-Ai and COM-Bi are prepared, and each is given a first half pattern and a second half pattern in a single period. A configuration is adopted in which the drive signal COM-Ai or COM-Bi is selected (or not selected) according to the gradation to be expressed in the first half and the second half of the single period and the selected (or not selected) signal is supplied to the piezoelectric element 60.

Figure 5:
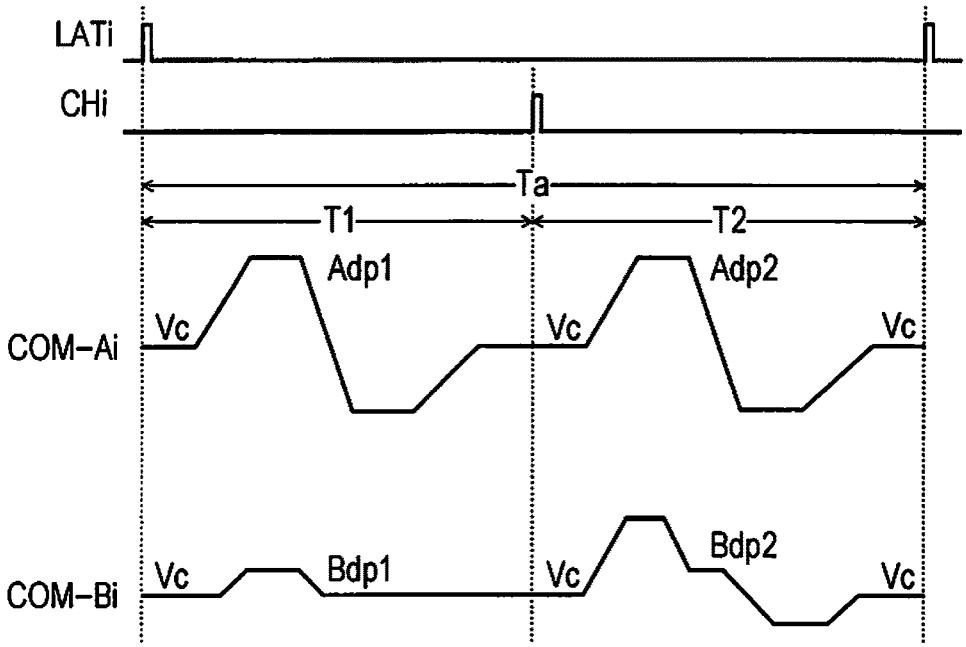
FIG. 5 is a diagram illustrating waveforms of drive signals.

FIG. 5 is a diagram illustrating waveforms of drive signals COM-Ai and COM-Bi. As illustrated in FIG. 5, the drive signal COM-Ai is a consecutive waveform in which a trapezoidal waveform Adp2 continues from a trapezoidal waveform Adp1. The trapezoidal waveform Adp1 is disposed in a period T1 from the leading edge of the latch signal LATi to the leading edge of the change signal CHi and the trapezoidal waveform Adp2 is disposed in a period T2 from the leading edge of the change signal CHi to the next leading edge of the latch signal LATi. A period which is formed from the period T1 and the period T2 is a period Ta, and for every period Ta, a new dot is formed on the medium M.

In the first embodiment, the trapezoidal waveforms Adp1 and Adp2 are substantially the same waveform as each other, and the trapezoidal waveforms Adp1 and Adp2 are waveforms which, if hypothetically supplied to one end of each of the piezoelectric elements 60, cause a predetermined amount, specifically, approximately a medium amount of the ink to be discharged from the nozzle 651 corresponding to the piezoelectric element 60.

The drive signal COM-Bi is a waveform in which a trapezoidal waveform Bdp2 which is disposed in the period T2 continues from a trapezoidal waveform Bdp1 which is disposed in the period T1. In the first embodiment, the trapezoidal waveforms Bdp1 and Bdp2 are waveforms which differ from each other. Of the two, the trapezoidal waveform Bdp1 is a waveform for subjecting the ink in the proximity of the open hole portion of the nozzle 651 to minute vibrations to prevent an increase in the viscosity of the ink. Therefore, even if the trapezoidal waveform Bdp1 is hypothetically supplied to one end of the piezoelectric element 60, an ink droplet is not discharged from the nozzle 651 corresponding to the piezoelectric element 60. The trapezoidal waveform Bdp2 is a waveform which differs from the trapezoidal waveform Adp1 (Adp2). The trapezoidal waveform Bdp2 is a waveform which, if hypothetically supplied to one end of the piezoelectric element 60, will cause a smaller amount of the ink than the predetermined amount to be discharged from the nozzle 651 corresponding to the piezoelectric element 60.

The voltages at the start timing and the voltages at the end timing of the trapezoidal waveforms Adp1, Adp2, Bdp1, and Bdp2 are all a voltage Vc in common. In other words, each of the trapezoidal waveforms Adp1, Adp2, Bdp1, and Bdp2 is a waveform which starts at the voltage Vc and ends at the voltage Vc.

Figure 6:
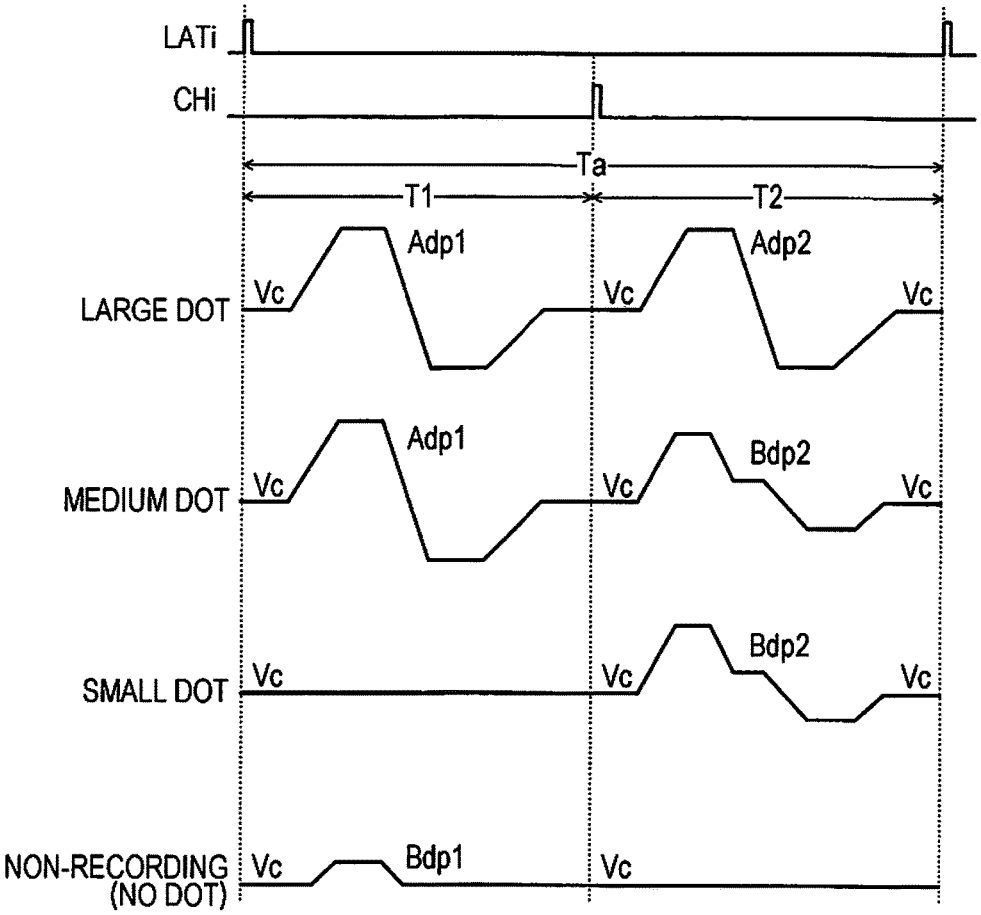
FIG. 6 is a diagram illustrating waveforms of drive signals.

FIG. 6 is a diagram illustrating waveforms of the drive signals Vout corresponding to each of "a large dot", "a medium dot", "a small dot", and "non-recording".

As illustrated in FIG. 6, the drive signal Vout corresponding to "the big dot" is a waveform in which the trapezoidal waveform Adp2 of the drive signal COM-Ai in the period T2 continues from the trapezoidal waveform Adp1 of the drive signal COM-Ai in the period T1. When the drive signal Vout is supplied to one end of the piezoelectric element 60, approximately a medium amount of the ink is divided into two and discharged from the nozzle 651 corresponding to the piezoelectric element 60 in the period Ta. Therefore, the droplets of ink land on the medium M and combine with one another to form the large dot.

The drive signal Vout corresponding to "the medium dot" is a waveform in which the trapezoidal waveform Bdp2 of the drive signal COM-Bi in the period T2 continues from the trapezoidal waveform Adp1 of the drive signal COM-Ai in the period T1. When the drive signal Vout is supplied to one end of the piezoelectric element 60, approximately a medium amount and approximately a small amount of the ink is divided into two and discharged from the nozzle 651 corresponding to the piezoelectric element 60 in the period Ta. Therefore, the droplets of ink land on the medium M and combine with one another to form the medium dot.

The drive signal Vout corresponding to "the small dot" becomes the voltage Vc directly before being held by the capacitance of the piezoelectric element 60 in the period T1 and becomes the trapezoidal waveform Bdp2 of the drive signal COM-Bi in the period T2. In the period Ta, when the drive signal Vout is supplied to one end of the piezoelectric element 60, approximately a small amount of the ink is discharged from the nozzle 651 corresponding to the piezoelectric element 60 in only the period T2. Therefore, the droplet of ink lands on the medium M to form the small dot.

The drive signal Vout corresponding to "the non-recording" is the trapezoidal waveform Bdp1 of the drive signal COM-Bi in the period T1 and becomes the voltage Vc directly before being held by the capacitance of the piezoelectric element 60 in the period T2. In the period Ta, when the drive signal Vout is supplied to one end of the piezoelectric element 60, the nozzle 651 corresponding to the piezoelectric element 60 only vibrates a minute amount in the period T2 and the ink is not discharged. Therefore, no droplets of the ink land on the medium M and no dot is formed.

1.5 Configuration of Selection Control Unit and Selection Unit

FIG. 7 is a diagram illustrating a configuration of the selection control unit 220. As illustrated in FIG. 7, the clock signal Sck, the print data signal SIi, the latch signal LATi, and the change signal CHi are supplied to the selection control unit 220. In the selection control unit 220, a group of a shift register (S/R) 222, a latch circuit 224, and a decoder 226 is provided corresponding to each of the piezoelectric elements 60 (the nozzles 651).

The print data signal SIi is a signal totaling 2*p* bits including two bits of print data (SIH, SIL) for selecting one of "the large dot", "the medium dot", "the small dot", and "the non-recording" with respect to each of p discharge units 600.

The print data signal SIi is supplied serially from the control signal restoring unit 250 in synchronization with the clock signal Sck. The configuration for temporarily holding the two bits of print data (SIH, SIL) which is included in the print data signal SIi corresponding to the nozzles is the shift register 222.

In detail, a configuration is adopted in which several stages of the shift registers 222 corresponding to the piezoelectric element 60 (the nozzle) are connected to each other in tandem and the print data signal SIi which is supplied serially is transferred sequentially to the later stages according to the clock signal Sck.

When the number of the piezoelectric elements 60 is set to p (where p is plural), in order to distinguish the shift registers 222, the shift registers 222 are denoted as first stage, second stage, . . . , pth stage in order from the upstream side from which the print data signal SIi is supplied.

Each of the p latch circuits 224 latches the two bit print data (SIH, SIL) which is held by each of the p shift registers 222 at the leading edge of the latch signal LATi.

Each of the p decoders 226 decodes the print data (SIH, SIL) which are latched by each of the p latch circuits 224, outputs selection signals Sa and Sb for every period T1 and T2 which are defined by the latch signal LATi and the change signal CHi to define the selection of the selection unit 230.

FIG. 8 is a table illustrating the decoded content of in the decoder 226. This means that, if the two bit print data (SIH, SIL) which is latched is (1, 0), for example, the decoder 226 outputs the logical levels of the selection signals Sa and Sb as the H and L levels, respectively, in the period T1, and as the L and H levels, respectively, in the period T2.

The logical levels of the selection signals Sa and Sb are level shifted by the level shifter (not illustrated) to higher amplitude logical levels than the logical levels of the clock signal Sck, the print data signal SIi, the latch signal LATi, and the change signal CHi.

FIG. 9 is a diagram illustrating the configuration of the selection unit 230 corresponding to one of the piezoelectric elements 60 (the nozzles 651).

As illustrated in FIG. 9, the selection unit 230 includes inverters (NOT circuits) 232*a* and 232*b* and transfer gates 234*a* and 234*b*.

While the selection signal Sa from the decoder 226 is supplied to the positive control terminal that does not have a circle mark in the transfer gate 234*a*, the selection signal Sa is logically inverted by the inverter 232*a* and is supplied to the negative control terminal that has a circle mark in the transfer gate 234*a*. In the same manner, while the selection signal Sb is supplied to the positive control terminal of the transfer gate 234*b*, the selection signal Sb is logically inverted by the inverter 232*b* and is supplied to the negative control terminal of the transfer gate 234*b*.

The drive signal COM-Ai is supplied to the input terminal of the transfer gate 234*a* and the drive signal COM-Bi is supplied to the input terminal of the transfer gate 234*b*. The output terminals of the transfer gates 234*a* and 234*b* are in common connection with each other and the drive signal Vout is output to the discharge unit 600 via the common connection terminal.

The transfer gate 234*a* causes between the input terminal and the output terminal to conduct (turn on) if the selection signal Sa is the H level, and causes between the input terminal and the output terminal to not conduct (turn off) if the selection signal Sa is the L level. Regarding the transfer gate 234*b*, between the input terminal and the output terminal is caused to turn on and off according to the selection signal Sb in the same manner.

Next, a description will be given of the operations between the selection control unit 220 and the selection unit 230 with reference to FIG. 10.

The print data signal SIi is supplied serially in synchronization with the clock signal Sck for every nozzle from the control signal restoring unit 250 and is sequentially transferred in the shift registers 222 corresponding to the nozzles. When the supply of the clock signal Sck from the control signal reception unit 240 stops, a state is assumed in which each of the shift registers 222 holds the two bit print data (SIR, SIL) corresponding to a nozzle. The print data signal SIi is supplied in an order corresponding to the final pth stage, . . . second stage, first stage nozzle in the shift registers 222.

Here, when the latch signal LATi rises, the latch circuits 224 all latch the two bit print data (SIH, SIL) which is held in the shift registers 222 at once. In FIG. 10, LT1, LT2, . . . , LTp indicate the two bit print data (SIH, SIL) which is latched by the latch circuits 224 corresponding to the first stage, second stage, . . . pth stage shift registers 222.

The decoder 226 outputs the logical levels of the selection signals Sa and Sb according to the content illustrated in FIG. 8 in each of the periods T1 and T2 according to the size of the dot which is defined by the latched two bit print data (SIH, SIL).

In other words, in a case in which the print data (SIH, SIL) is (1, 1) and defines a large dot size, the decoder 226 sets the selection signals Sa and Sb to the H and L levels in the period T1 and to the H and L levels in the period T2. In a case in which the print data (SIH, SIL) is (1, 0) and defines a medium dot size, the decoder 226 sets the selection signals Sa and Sb to the H and L levels in the period T1 and to the L and H levels in the period T2. In a case in which the print data (SIH, SIL) is (0, 1) and defines a small dot size, the decoder 226 sets the selection signals Sa and Sb to the L and L levels in the period T1 and to the L and H levels in the period T2. In a case in which the print data (SIH, SIL) is (0, 0) and defines non-recording, the decoder 226 sets the selection signals Sa and Sb to the L and H levels in the period T1 and to the L and L levels in the period T2.

When the print data (SIH, SIL) is (1, 1), since the selection signals Sa and Sb are the H and L levels in the period T1, the selection unit 230 selects the drive signal COM-Ai (the trapezoidal waveform Adp1), and since Sa and Sb are also the H and L levels in the period T2, the selection unit 230 selects the drive signal COM-Ai (the trapezoidal waveform Adp2). As a result, the drive signal Vout corresponding to "the large dot" illustrated in FIG. 6 is generated.

When the print data (SIH, SIL) is (1, 0), since the selection signals Sa and Sb are the H and L levels in the period T1, the selection unit 230 selects the drive signal COM-Ai (the trapezoidal waveform Adp1), and since Sa and Sb are the L and H levels in the period T2, the selection unit 230 selects the drive signal COM-Bi (the trapezoidal waveform Bdp2). As a result, the drive signal Vout corresponding to "the medium dot" illustrated in FIG. 6 is generated.

When the print data (SIH, SIL) is (0, 1), since the selection signals Sa and Sb are the L and L levels in the period T1, the selection unit 230 does not select either of the drive signals COM-Ai and COM-Bi, and since Sa and Sb are the L and H levels in the period T2, the selection unit 230 selects the drive signal COM-Bi (the trapezoidal waveform Bdp2). As a result, the drive signal Vout corresponding to "the small dot" illustrated in FIG. 6 is generated. Since neither of the drive signals COM-Ai and COM-Bi is selected in the period T1, one end of the piezoelectric element 60 becomes open, and, due to the capacitance of the piezoelectric element 60, the drive signal Vout is held at the voltage Vc of directly before.

When the print data (SIH, SIL) is (0, 0), since the selection signals Sa and Sb are the L and H levels in the period T1, the selection unit 230 selects the drive signal COM-Bi (the trapezoidal waveform Bdp1), and since the selection signals Sa and Sb are the L and L levels in the period T2, the selection unit 230 does not select either of the drive signals COM-Ai and COM-Bi. As a result, the drive signal Vout corresponding to "non-recording" illustrated in FIG. 6 is generated. Since neither of the drive signals COM-Ai and COM-Bi is selected in the period T2, one end of the piezoelectric element 60 becomes open, and, due to the capacitance of the piezoelectric element 60, the drive signal Vout is held at the voltage Vc of directly before.

Figure 10:
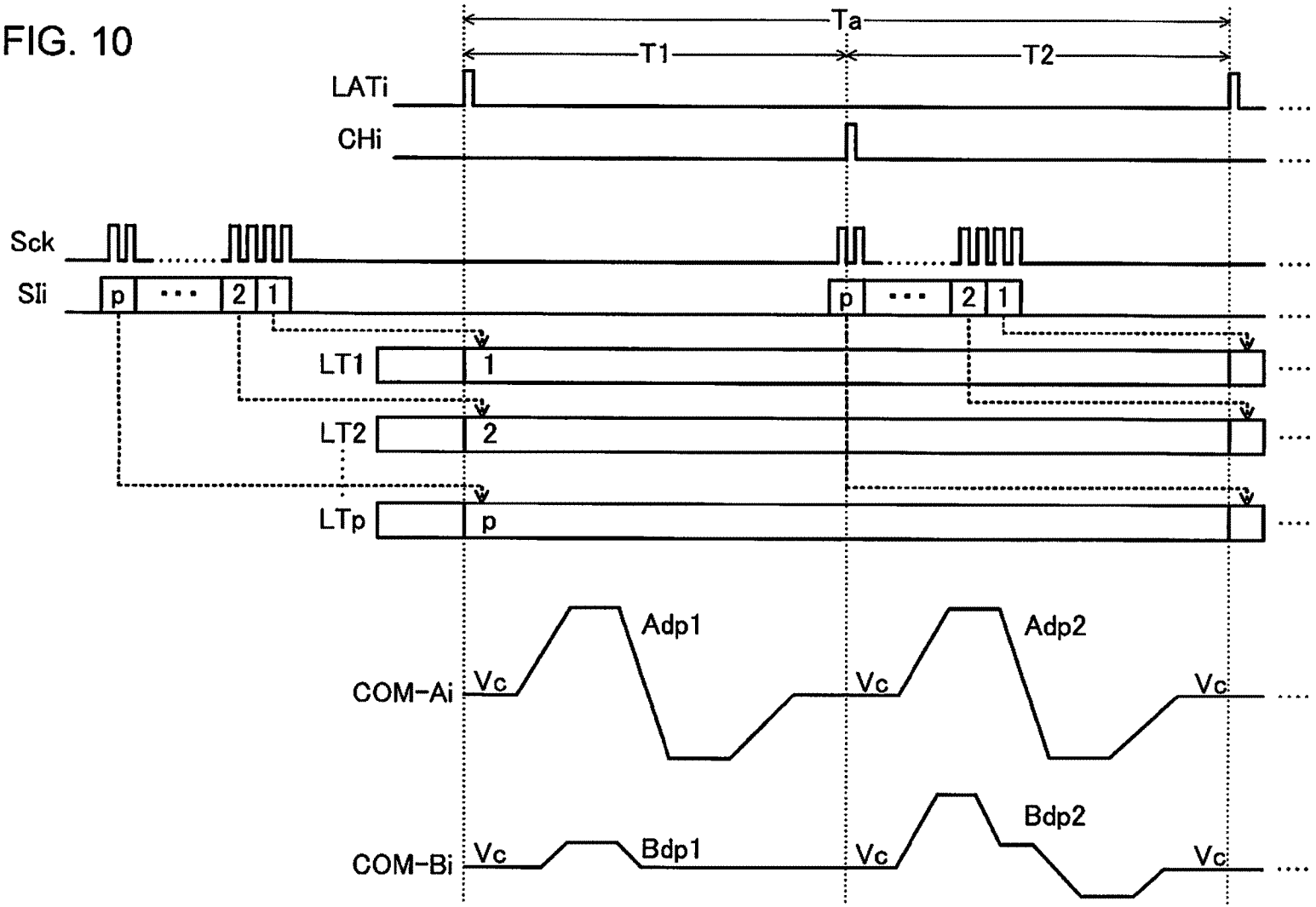
FIG. 10 is a diagram for describing the operations of the selection control unit and the selection unit.

The drive signals COM-Ai and COM-Bi illustrated in FIGS. 5 and 10 are merely examples. In actuality, various preprepared combinations of waveforms are used according to the transport speed of the liquid discharging unit 2, the properties of the medium M, and the like.

Here, although a description is given of an example in which the piezoelectric element 60 flexes in the upward direction with a rise in the voltage, when the voltage which is supplied to the electrodes 611 and 612 is inverted, the piezoelectric element 60 flexes in the downward direction with a rise in the voltage. Therefore, in a configuration in which the piezoelectric element 60 flexes in the downward direction with a rise in the voltage, the drive signals COM-Ai and COM-Bi exemplified in FIGS. 5 and 10 become inverted waveforms which are inverted using the voltage Vc as a reference.

1.6 Structure of Liquid Discharging Unit

Figure 11:
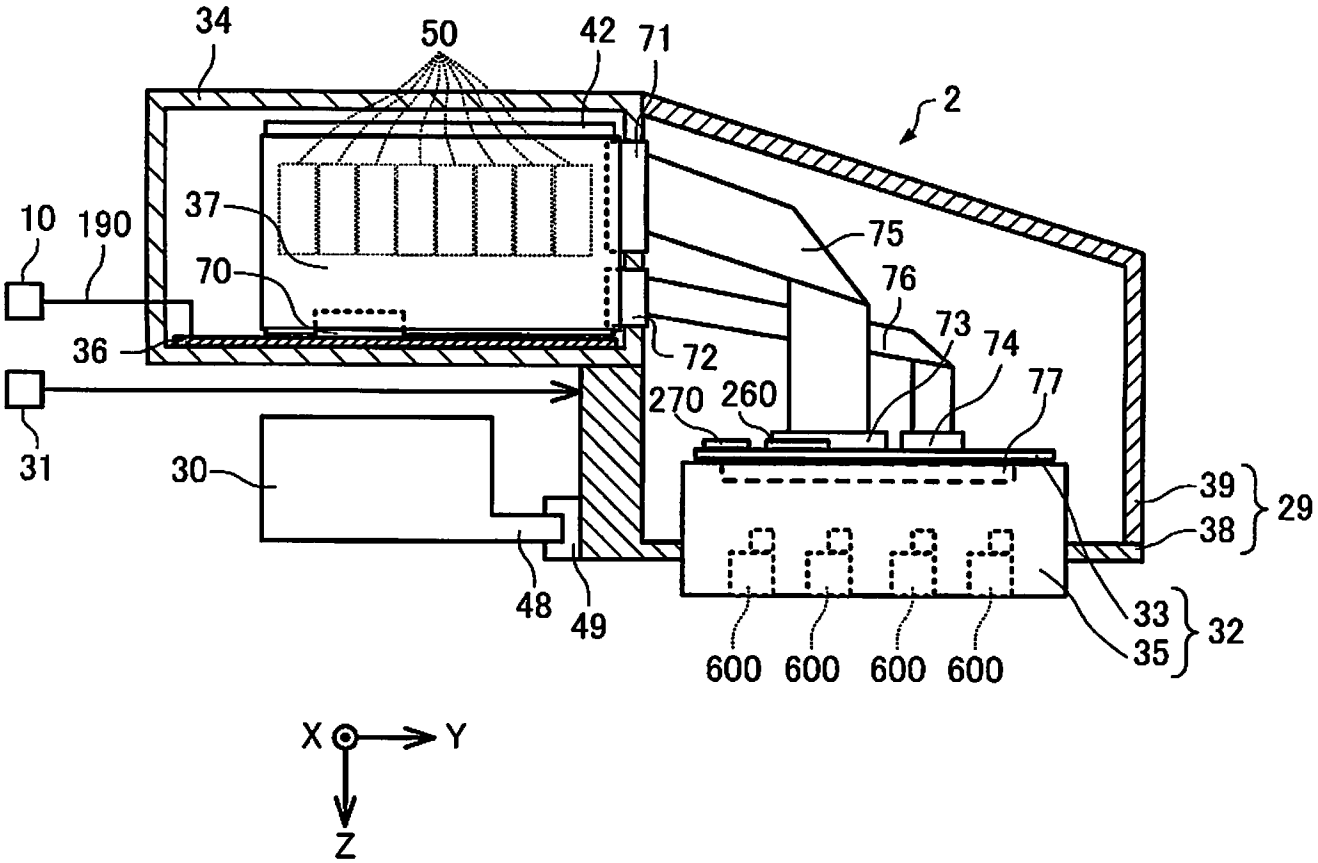
FIG. 11 is a lateral schematic view illustrating a configuration of a periphery of a liquid discharging unit.
Figure 12:
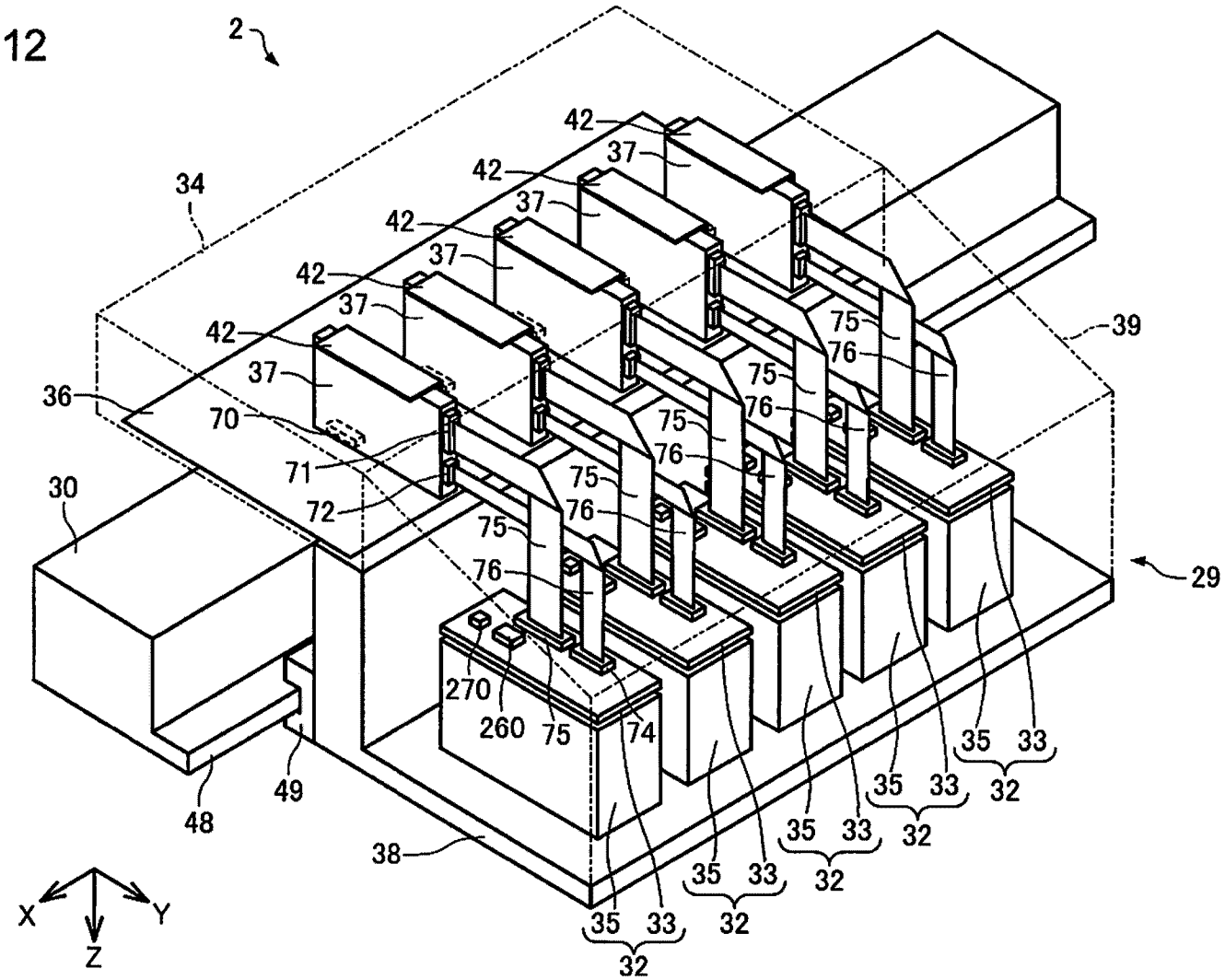
FIG. 12 is a schematic perspective view illustrating an internal configuration of the liquid discharging unit.
Figure 13:
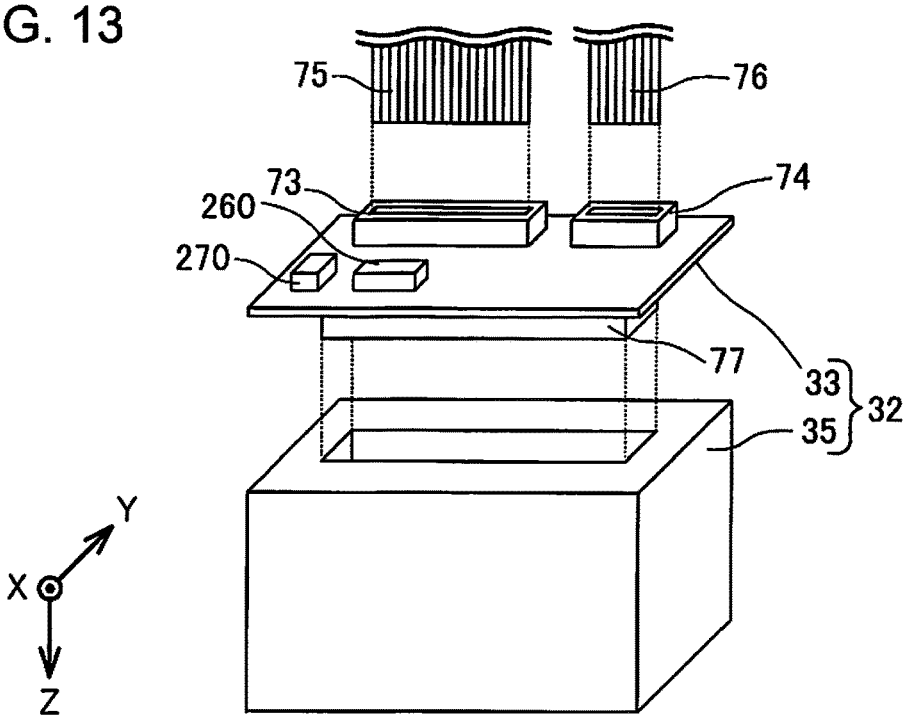
FIG. 13 is an exploded perspective view illustrating a configuration of a head unit.

FIG. 11 is a lateral schematic view illustrating a configuration of a periphery of the liquid discharging unit 2 in the first embodiment. FIG. 12 is a schematic perspective view illustrating an internal configuration of the liquid discharging unit 2. FIG. 13 is an exploded perspective view illustrating a configuration of the head unit 32.

As illustrated in FIG. 11, the carriage 29 is provided with a carriage main body 38 and a cover member 39. The cross-section of the carriage main body 38 forms an L-shape when viewed from the first direction X, and the cover member 39 is attached to the carriage main body 38 in a freely attachable and detachable manner to form a closed space with the carriage main body 38.

The front end portion of the heat radiating case 34 which is a parallelepiped and stores the plurality of (N) drive circuit units 37 and the relay substrate 36 is fixed to the rear portion of the carriage 29. Therefore, the plurality of (N) drive circuit units 37 and the relay substrate 36 are supported by the carriage 29 via the heat radiating case 34.

Various circuit components (not illustrated) which configure the relay module 300 (refer to FIG. 3) are installed on the relay substrate 36 and the flexible flat cable 190 is connected to the relay substrate 36. A plurality of (N) drive circuit units 37 is connected to the relay substrate 36 via a B-to-B connector 70. In other words, signals from the control unit 10 including the differential signals dcS1 to dcSm, the differential clock signal dClk, the voltage signal Vh, and the drive data dcA1 to dcAm and dcB1 to dcBm are input to the relay substrate 36 via the flexible flat cable 190. The relay substrate 36 splits the plurality of signals which are input and outputs the differential signals dS1 to dSn, the differential clock signal dClk, the voltage signal Vh, and the drive data dA1 to dAn and dB1 to dBn to each of the plurality of (N) drive circuit units 37 which is connected via the B-to-B connector 70.

Each of the plurality of (N) drive circuit units 37 includes the various circuit components (not illustrated) which configure a drive circuit 50 which is actually measured, the B-to-B connector 70, and FFC connectors 71 and 72 on a circuit substrate (not illustrated). Each of the drive circuit units 37 is provided with a heat radiating plate 42 for conducting the heat which is generated by the drive circuit unit 37 to the heat radiating case 34. In the first embodiment, since the plurality of (N) drive circuit units 37 all have the same configuration, the description will be carried out with a single drive circuit unit 37 as representative.

The B-to-B connector 70 is a connector for performing the connection of the circuit substrate on which the various circuit components that configure the drive circuit 50 are installed and the relay substrate 36, and, for example, the B-to-B connector 70 is configured using a board to board connector. By connecting the circuit substrate which is actually measured and on which the various circuit components that configure the drive circuit 50 are installed and the relay substrate 36 using a board to board connector, it is not necessary to provide a wiring (a cable) between the circuit substrate and the relay substrate 36 and it is possible to mount the circuit substrates at a high density.

The B-to-B connector 70 is provided on the circuit substrate on which the various circuit components that configure the drive circuit 50 are installed. The B-to-B connector 70 is provided such that the circuit substrate and the relay substrate 36 are connected in a direction at which the surface (the drive circuit mounting surface) on which the various circuit components that configure the 2n drive circuits 50 (50-*a*1 to 50-*an* and 50-*b*1 to 50-*bn*) which are installed on the circuit substrate and the surface of the relay substrate 36 intersect. According to this connection structure, the region of the relay substrate 36 in which the drive circuit unit 37 is connected decreases in size, and it becomes possible to mount the plurality of (N) drive circuit units 37 on the carriage 29 at a higher density. Due to the drive circuit units 37 and the relay substrate 36 being connected to each other via the B-to-B connector 70 to be freely attachable and detachable (possible to freely insert and remove), in a case in which exchanging of the drive circuit unit 37 becomes necessary, it is possible to easily exchange the drive circuit unit 37 which is an exchanging target.

The heat radiating plate 42 radiates the heat which is generated by the parts of the drive circuit unit 37. The heat radiating plate 42 is provided on the opposite side from the drive circuit mounting surface of the circuit substrate on which the various circuit components that configure the drive circuit 50 which is provided on the drive circuit unit 37 are installed. There is a vacant region (a flat region) which is large in comparison to the drive circuit mounting surface on the surface of the opposite side from the drive circuit mounting surface. A heat transmitting sheet (not illustrated), for example, is bonded in close adhesion to the vacant region and the heat radiating plate 42 is fixed to the circuit substrate of the drive circuit unit 37 in a state of being in contact with the heat transmitting sheet. Accordingly, it is possible to increase the size of the contact area between the heat radiating plate 42 and the heat transmitting sheet. Accordingly, it is possible to efficiently conduct the heat which is generated by the drive circuit unit 37 to the heat transmitting sheet and the heat radiating plate 42. Furthermore, it is preferable that the heat radiating plate 42 be in contact with the heat radiating case 34. Accordingly, it is possible to further efficiently conduct the heat which is conducted to the heat radiating plate 42 to the heat radiating case 34.

Here, it is preferable that the heat radiating case 34 and the heat radiating plate 42 be configured as described next in order to efficiently radiate the heat which is generated by the drive circuit unit 37 to the outside. In other words, it is preferable that the contact area between the heat radiating case 34 and the heat radiating plate 42 be increased in size in order to increase the heat transmission amount from the heat radiating plate 42 to the heat radiating case 34. It is preferable that the heat radiating case 34 and the heat radiating plates 42 be formed of a metal material having high heat conductivity such as aluminum in order for the heat to be easily conducted. In order to increase the heat radiation amount from the heat radiating case 34 to the outside air, heat radiating fins may be provided on the outside of the heat radiating case 34, and in this case, it is preferable that the area of the heat radiating find that contact the outside air be increased in size.

The FFC connectors 71 and 72 are provided on the circuit substrate on which the various circuit components that configure the drive circuit 50 are installed. The FFC connectors 71 and 72 are exposed to the inside of the carriage 29 from the front surface of the heat radiating case 34. The FFC connectors 71 and 72 are connected to an FFC connector 73 and an FFC connector 74 which are provided on the head unit 32 (described later) via a cable 75 (an example of "the cable") and a cable 76. Specifically, one end portion of the cable 75 which is configured by a flexible flat cable (FFC), for example, is connected to the FFC connector 71 to be freely attachable and detachable (possible to freely insert and remove) and the other end portion of the cable 75 is connected to the FFC connector 73 to be freely attachable and detachable. In the same manner, one end portion of the cable 76 which is configured by an FFC, for example, is connected to the FFC connector 72 to be freely attachable and detachable and the other end portion of the cable 76 is connected to the FFC connector 74 to be freely attachable and detachable. In other words, the drive circuit unit 37 and the head unit 32 are electrically connected to one another via the two cables 75 and 76.

According to the above description, the drive circuit unit 37 outputs the drive signals COM-A1 to COM-An and COM-B1 to COM-Bn, the voltage signals Vh1 to Vhn, and the reference voltage signal VBS to the head unit 32 via the FFC connector 71 and the cable 75, for example. In other words, a plurality of output terminals which outputs each of the drive signals COM-A1 to COM-An and COM-B1 to COM-Bn, the voltage signals Vh1 to Vhn, and the reference voltage signal VBS is provided on the FFC connector 71. The drive circuit unit 37 outputs the differential signals dS1 to dSn and the differential clock signal dClk to the head unit 32 via the FFC connector 72 and the cable 76, for example. In other words, a plurality of output terminals which Outputs each of the differential signals dS1 to dSn and the differential clock signal dClk is provided on the FFC connector 72.

In this manner, in the first embodiment, the drive signals COM-A1 to COM-An and COM-B1 to COM-Bn, the voltage signals Vh1 to Vhn, and the reference voltage signal VBS, all of which have large amplitudes (for example, several tens of volts), are transferred to the head unit 32 by the cable 75 which is connected to the FFC connector 71, and the differential signals dS1 to dSn and the differential clock signal dClk, all of which have small amplitudes (for example, several hundreds of millivolts) are transferred to the head unit 32 by the cable 76 which is connected to the FFC connector 72.

In the first embodiment, as illustrated in FIG. 12, the plurality of (in the first embodiment, 5) drive circuit units 37 is supported inside the heat radiating case 34 in a state in which the drive circuit units 37 are arranged at an equal interval in the first direction X.

As illustrated in FIGS. 11 and 12, the plurality of (in the first embodiment, 5) head units 32 corresponding to each of the plurality of (in the first embodiment, 5) drive circuit units 37 is supported on the bottom portion inside the carriage 29 in a state in which the head units 32 are arranged at an equal interval in the first direction X. As described earlier (refer to FIGS. 1 and 2), the bottom end portion of each of the head units 32 protrudes to the outside from the bottom surface of the carriage 29. The plurality of discharge units 600 from which the ink is discharged is opened in the bottom surface of each of the head units 32 which protrude from the carriage 29 in a state in which the discharge units 600 are arranged in the second direction Y. The head unit 32 discharges the ink from the discharge units 600 based on the differential signals dS1 to dSn, the differential clock signal dClk, the drive signals COM-A1 to COM-An and COM-B1 to COM-Bn, and the reference voltage signal VBS.

As illustrated in FIGS. 11, 12, and 13, the head unit 32 includes the wiring substrate 33 and the exchangeable print head 35.

The drive signals COM-A1 to COM-An and COM-B1 to COM-Bn, the voltage signals Vh1 to Vhn, and the reference voltage signal VBS are input to the wiring substrate 33 via the cable 75, and the differential signals dS1 to dSn and the differential clock signal dClk are input to the wiring substrate 33 via the cable 76. The wiring substrate 33 outputs the plurality of input signals to the print head 35 via a B-to-B connector 77 (an example of "the connector").

The wiring substrate 33 includes the FFC connectors 73 and 74 and the B-to-B connector 77. A plurality of circuit components that configure the exchange detection unit 260 which is described earlier (refer to FIG. 3) and a plurality of circuit components that configure the exchange notification unit 270 are installed on the wiring substrate 33.

The FFC connector 73 is provided on the surface of the wiring substrate 33. The other end portion of the cable 75 is connected to the FFC connector 73 to be freely attachable and detachable. In other words, the drive signals COM-A1 to COM-An and COM-B1 to COM-Bn, the voltage signals Vh1 to Vhn, and the reference voltage signal VBS which are output from the drive circuit unit 37 are input to the wiring substrate 33 via the FFC connector 73.

The FFC connector 74 is provided on the surface of the wiring substrate 33. The other end portion of the cable 76 is connected to the FFC connector 74 to be freely attachable and detachable. In other words, the differential signals dS1 to dSn and the differential clock signal dClk which are output from the drive circuit unit 37 are input to the wiring substrate 33 via the FFC connector 74.

The B-to-B connector 77 is provided on the surface of the wiring substrate 33. The B-to-B connector 77 is connected to the print head 35 to be freely attachable and detachable. It is preferable that the B-to-B connector 77 be a board to board connector which connects the wiring substrate 33 to a head substrate (not illustrated) which is provided on the print head 35. Due to the wiring substrate 33 being connected to the print head 35 by the board to board connector, complicated wiring (cabling) is no longer necessary and complication of the configuration of the print head 35 to be exchanged is reduced, and it becomes possible to more reliably and more easily perform the exchanging work of the print head 35 by connecting the wiring substrate 33 to the head substrate (not illustrated) which is provided on the print head 35.

It is preferable that the B-to-B connector 77 be configured of as small a number as possible (in the first embodiment, one), as illustrated in the first embodiment. By reducing the number of the B-to-B connectors 77, it is possible to further improve the ease of the exchanging work of the print head 35. At this time, the drive signals COM-A1 to COM-An and COM-B1 to COM-Bn, the voltage signals Vh1 to Vhn, and the reference voltage signal VBS, all of which have large amplitudes (for example, several tens of volts), and the differential signals dS1 to dSn and the differential clock signal dClk, all of which have small amplitudes (for example, several hundreds of millivolts) are transferred to the print head 35 via the B-to-B connector 77. Therefore, by providing the B-to-B connector 77 with a terminal which transfers a ground potential, for example, between the output terminal from which the drive signals COM-A1 to COM-An and COM-B1 to COM-Bn, the voltage signals Vhf to Vhn, and the reference voltage signal VBS, all of which have large amplitudes (for example, several tens of volts) are output, and the output terminal from which the differential signals dS1 to dSn and the differential clock signal dClk, all of which have small amplitudes (for example, several hundreds of millivolts) are output, it is possible to reduce the possibility of the differential signals dS1 to dSn and the differential clock signal dClk, all of which have small amplitudes, interfering with the drive signals COM-A1 to COM-An and COM-B1 to COM-Bn, the voltage signals Vh1 to Vhn, and the reference voltage signal VBS.

In the first embodiment, the two cables 75 and 76 are connected to the drive circuit unit 37 and the wiring substrate 33. However, the drive circuit unit 37 and the wiring substrate 33 may be connected by a single cable, and may be connected by three or more cables.

The exchange detection unit 260 detects that the exchanging of the print head 35 is possible. Therefore, it is preferable that the exchange detection unit 260 be provided in the vicinity of the exchanging target print head 35. Accordingly, the exchange detection unit 260 is capable of precisely detecting that the exchanging of the print head 35 is possible. In detail, the exchange detection unit 260 is included in the head unit 32 which includes the print head 35 to be exchanged. By providing the exchange detection unit 260 on the head unit 32 together with the exchanging target print head 35, it is possible to dispose the exchange detection unit 260 in the vicinity of the print head 35. Accordingly, the exchange detection unit 260 is capable of precisely detecting that the exchanging of the print head 35 is possible. Accordingly, it is possible to more reliably perform the exchanging work of the print head 35.

At this time, as illustrated in the first embodiment, it is preferable that the exchange detection unit 260 be provided on the wiring substrate 33. As described earlier, the print head 35 to be exchanged is electrically connected to the wiring substrate 33 which is not exchanged by the B-to-B connector 77 to be attachable and detachable. Accordingly, the exchange detection unit 260 is capable of detecting that the exchanging of the print head 35 is possible in the vicinity of the connector which is electrically connected to the exchangeable print head 35. Accordingly, the detection precision of the exchange detection unit 260 is further improved. By providing the exchange detection unit 260 on the wiring substrate 33 which is not exchanged, it is possible to reduce an increase in the number of components of the print head 35 to be exchanged and to reduce the complication of the structure of the print head 35.

In the first embodiment, although the exchange detection unit 260 is provided on the surface of the wiring substrate 33, the exchange detection unit 260 may be provided on the reverse surface of the wiring substrate 33.

The exchange notification unit 270 functions as a notification unit which notifies an exchanging worker of the fact that the exchanging of the print head 35 is possible when the exchange detection unit 260 detects that the exchanging of the print head 35 is possible.

In the first embodiment, the exchange notification unit 270 is provided with an LED element as an example of the notification unit. For example, when the LED element is lit, the exchange notification unit 270 notifies the exchanging worker of the fact that the exchanging of the print head 35 is not possible with the assumption that the exchange detection unit 260 is not detecting that the exchanging of the print head 35 is possible. For example, when the LED element is not lit (or is dimmed), the exchange notification unit 270 notifies the exchanging worker of the fact that the exchanging of the print head 35 is possible with the assumption that the exchange detection unit 260 detects that the exchanging of the print head 35 is possible. In this manner, the LED element functions as the notification unit which visually notifies the exchanging worker of the fact that the exchanging of the print head 35 is possible. Therefore, it is preferable that the LED element which functions as the notification unit be provided at a visually recognizable position. For the visually recognizable position, the LED element may be provided on the cable 75, the cable 76, or the like, for example, and may be provided on the housing of the liquid discharging apparatus 1, for example. The LED element may be provided at any position at which the light emission and non-lighting (or dimming) of the LED element can be visually recognized, for example, even if the LED element may not be directly viewed, the LED element may be provided at a position at which the reflected light from the light emission and non-lighting (or dimming) of the LED element can be visually recognized.

When the exchange notification unit 270 is the notification unit which visually performs notification of the fact that the exchanging of the print head 35 is possible, it is preferable that the exchange notification unit 270 be provided on the wiring substrate 33 as illustrated in the first embodiment. When performing the exchanging work of the print head 35, ordinarily, the worker views the exchanging target print head 35 and the wiring substrate 33 which includes the B-to-B connector 77 which is connected to the print head 35 and performs the work. Therefore, due to the notification unit (the exchange notification unit 270) which visually performs notification of the fact that the exchanging of the print head 35 is possible being provided on the surface of the wiring substrate 33, it becomes possible to efficiently notify the exchanging worker of the fact that the exchanging of the print head 35 is possible.

The notification unit with which the exchange notification unit 270 is provided is not limited to being an LED element, and may be an EL element, for example. The notification unit may be a notification unit which audibly performs the notification using a buzzer or the like, and further, may be a notification unit which performs the notification using characters, symbols, or the like on a liquid crystal panel or the like.

The print head 35 is configured to be exchangeable and to include the discharge control unit 20 that includes the plurality of discharge units 600 (as described earlier), and performs printing on the medium M by discharging ink droplets from the discharge units 600 based on the drive signals COM-A1 to COM-An and COM-B1 to COM-Bn, the voltage signals Vhf to Vhn, the reference voltage signal VBS, the differential signals dS1 to dSn, and the differential clock signal dClk which are output from the drive circuit unit 37.

The guide member 30 includes a guide rail portion 48 which extends in the first direction X on the bottom portion of the front surface of the guide member 30. The carriage 29 is supported to be capable of moving in the first direction X by the guide rail portion 48 on a carriage support portion 49 which is provided on the bottom portion of the rear surface of the carriage 29. In other words, the carriage support portion 49 is connected to the guide rail portion 48 to be capable of sliding in the first direction X. In other words, the carriage 29 supports the head units 32 which include the discharge units 600 and the heat radiating case 34 which includes the drive circuit units 37 and moves reciprocally along the first direction X while being guided by the guide rail portion 48 of the guide member 30 on the carriage support portion 49 according to the driving of the carriage motor 31.

In this manner, in the first embodiment, the relay substrate 36, the drive circuit units 37, and the head units 32 are mounted on the movable carriage 29. In a hypothetical case in which the drive circuit units 37 are installed on the carriage 29, since the drive signals COM-A1 to COM-An and COM-B1 to COM-Bn are transferred by the extremely long flexible flat cable 190, it is considered that large overshooting and ringing will occur in the drive waveforms and the discharge precision of the liquid from the head units 32 will be degraded. In contrast, in the first embodiment, since the drive circuit units 37 are mounted on the carriage 29, the length of the wiring over which the drive signals COM-A1 to COM-An and COM-B1 to COM-Bn are transferred to the piezoelectric elements 60 becomes shorter, and since it is possible to reduce the overshooting and the ringing which occur in the drive waveforms, it is possible to cause the liquid to be precisely discharged from the head units 32. In other words, even when the liquid discharging apparatus 1 is a large format printer (LFP) which is capable of performing the printing on the medium M of A3 short-side width or larger, it is possible to cause the liquid to be precisely discharged from the head units 32.

The carriage 29 is positioned on the side portion of the front side of the guide member 30 and the heat radiating case 34 which stores the drive circuit units 37 is positioned on the top side of the guide member 30. Accordingly, the rotational moment of the carriage 29 using the carriage support portion 49 as a fulcrum is suppressed to a small level and it is possible to shorten the lengths of the cables 75 and 76. Therefore, the weight balance of the carriage 29 is stabilized and the signals which are output from the drive circuit units 37 to the head units 32 are stabilized.

1.7 Circuit Configurations of Exchange Detection Unit 260 and Exchange Notification Unit 270

Here, a description will be given of examples of the circuit configurations of the exchange detection unit 260 and the exchange notification unit 270 using FIG. 14.

Figure 14:
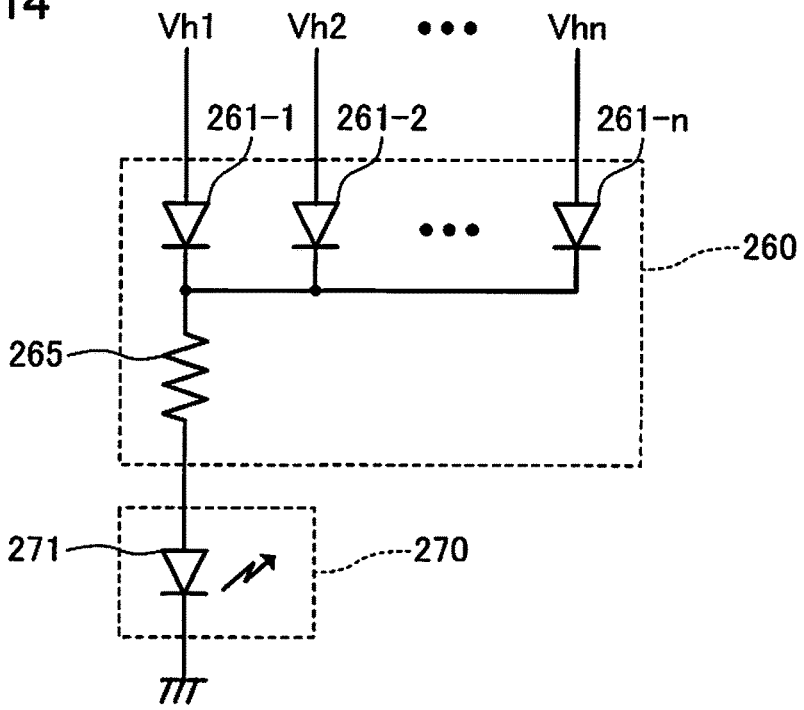
FIG. 14 is a diagram illustrating an example of a detection circuit and a notification unit of a first embodiment.

FIG. 14 is a circuit diagram illustrating the configurations of the exchange detection unit 260 and the exchange notification unit 270.

In the first embodiment, the exchange detection unit 260 detects that the exchanging is possible by detecting the conducting state to the print head 35 based on the plurality of (n) voltage signals Vh1 to Vhn which are output from the drive circuit unit 37. As described earlier (refer to FIG. 3), the plurality of (2n) drive circuits 50 (50-*a*1 to 50-*an* and 50-*b*1 to 50-*bn*) which are included in the drive circuit unit 37 output the drive signals COM-A1 to COM-An and COM-B1 to COM-Bn based on the voltage signals Vh1 to Vhn. In other words, by detecting the conducting state to the print head 35 based on the voltage signals Vh1 to Vhn, the exchange detection unit 260 is capable of detecting the conducting state to the print head 35 which includes the drive signals COM-A1 to COM-An and COM-B1 and COM-Bn.

The exchange detection unit 260 includes a plurality of (n) diodes 261-1 to 261-*n* and a resistance 265.

The plurality of (n) voltage signals Vh1 to Vhn are input to the anodes of each of the plurality of (n) diodes 261-1 to 261-*n*. The cathodes of the plurality of (n) diodes 261-1 to 261-*n* are connected in common. In other words, the plurality of (n) diodes 261-1 to 261-*n* are wired-OR connected. In other words, a signal which is obtained by combining the plurality of (n) voltage signals Vh1 to Vhn is output to the cathodes of the plurality of (n) diodes 261-1 to 261-*n*.

The cathodes of the plurality of (n) diodes 261-1 to 261-*n* are connected in common to one end of the resistance 265 and the other end of the resistance 265 is output from the exchange detection unit 260.

The exchange notification unit 270 includes an LED 271. The anode of the LED 271 is connected to the output of the exchange detection unit 260 (the other end of the resistance 265) and the cathode of the LED 271 is connected to the ground potential.

Here, a detailed description will be given later of the operations of the exchange detection unit 260 and the exchange notification unit 270.

When an exchanging request of the print head 35 arises, the supply of power to the print head 35 stops. At this time, the voltage levels of the plurality of (n) voltage signals Vh1 to Vhn gradually decrease (discharge). The speed at which the voltage levels of the plurality of (n) voltage signals Vh1 to Vhn decrease varies according to the load that is connected to each of the plurality of (n) voltage signals Vh1 to Vhn, the circuit configuration, the stray capacitance of the wiring, and the like.

The plurality of (n) voltage signals Vhf to Vhn are respectively input to each of the anodes of the plurality of (n) wired-or connected diodes 261-1 to **261-*n* of the exchange detection unit 260. The voltage signal which is based on the voltage signal Vhj (where j is any number from 1 to n) which has the greatest voltage level is output to the cathode of the plurality of (n) diodes 261-1 to 261-*n***.

The resistance 265 converts the voltage signal which is based on the voltage signal Vhj (where j is any number from 1 to n) which is output to the cathodes of the plurality of (n) diodes 261-1 to **261-*n* into a current and outputs the result. For example, when the voltage level which is output to the cathodes of the plurality of (n) diodes 261-1 to 261-*n* is high and the conductivity to the print head 35 continues, the resistance 265 outputs the current of a level at which the LED 271 of the exchange notification unit 270 is lit, indicating that the exchanging of the print head 35 is not possible. When the voltage level which is output to the cathodes of the plurality of (n) diodes 261-1 to 261-*n* is low and the conductivity to the print head 35 stops, the resistance 265 outputs the current of a level at which the LED 271 of the exchange notification unit 270 is not lit (or is dimmed), indicating that the exchanging of the print head 35 is possible. In other words, the resistance 265 detects that the exchanging of the print head 35 is possible, based on the voltage level of the voltage signal Vhj (where j is a number from 1 to n) to be detected. It is possible to determine (or change) the detection threshold at which the resistance 265 detects that the exchanging of the print head 35 is possible using the resistance value of the resistance 265**.

The LED 271 of the exchange notification unit 270 notified the exchanging worker of the fact that the exchanging of the print head 35 is possible by lighting or not being lit (or being dimmed) based on the current that is output from the resistance 265.

As described above, the exchange detection unit 260 selects the voltage signal Vhj that has the greatest voltage level in the plurality of (n) voltage signals Vh1 to Vhn using the plurality of (n) diodes 261-1 to **261-*n*. The resistance 265 determines the conducting state to the print head 35 based on the voltage signal Vhj and detects that the exchanging of the print head 35 is possible. The exchange notification unit 270 notifies the exchanging worker of the fact that the exchanging of the print head 35 is possible, based on the output from the exchange detection unit 260**.

Accordingly, the exchange detection unit 260 and the exchange notification unit 270 perform the detection of the fact that the exchanging of the print head 35 is possible, based on the voltage signal Vhj (where j is a number from 1 to n) that has the greatest voltage level among the plurality of (n) voltage signals Vh1 to Vhn. Therefore, one of each of the resistance 265 and the LED 271 may be provided regardless of the number of the plurality of (n) voltage signals Vh1 to Vhn. Accordingly, it is possible to reduce an increase in the circuit scale of the exchange detection unit 260 and the exchange notification unit 270.

1.8 Method of Detecting Capability of Exchanging Print Head

Figure 15:
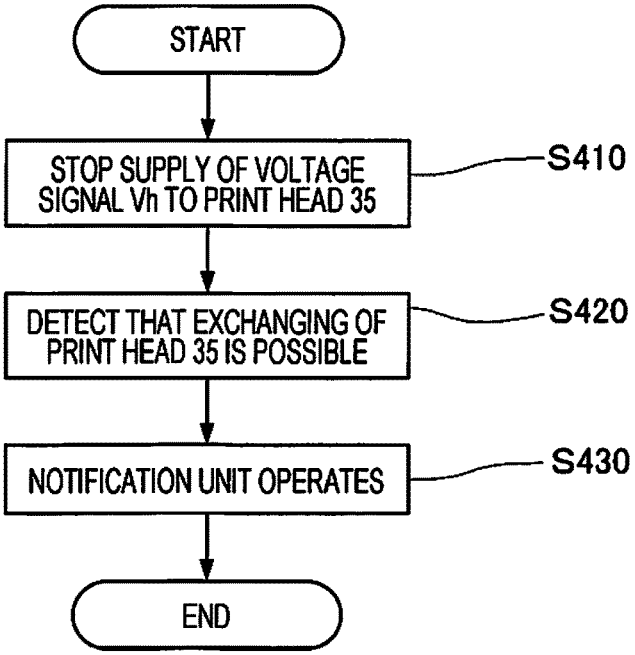
FIG. 15 is a flowchart illustrating a method of detecting that exchanging of a print head is possible.

FIG. 15 is a flowchart illustrating a method of detecting that the exchanging of the print head 35 is possible.

For the exchanging of the print head 35, the exchanging worker (the user) first uses a manipulating portion (not illustrated) and performs an exchanging instruction of the print head 35.

When the exchanging instruction of the print head 35 arises, the supply of the voltage signal Vh to the liquid discharging unit 2 (the print head 35) stops (step S410). For the stopping of the supply of the voltage signal Vh to the liquid discharging unit 2 (the print head 35), for example, the voltage generation unit 150 may stop the generation of the voltage signal Vh, and for example, a configuration may be adopted in which a switch is provided in the wiring over which the voltage signal Vh is transferred and the electrical connection of the wiring over which the voltage signal Vh is transferred may be cut off by a control unit (not illustrated) manipulating the switch.

After the supplying of the voltage signal Vh to the liquid discharging unit 2 (the print head 35) stops, the exchange detection unit 260 which is provided on the head unit 32 detects that the exchanging of the print head 35 is possible (step S420). For example, the exchange detection unit 260 performs the detection of the fact that the exchanging of the print head 35 is possible, based on the conducting state (the voltage level) of the print head 35. For example, the conducting state (the voltage level) of the print head 35 may be detected based on whether or not the voltage signal Vh (Vh1 to Vhn) is less than or equal to a predetermined value, and may be detected based on whether or not the average value of the drive signals COM-A1 to COM-An and COM-B1 to COM-Bn is less than or equal to a predetermined value.

When the exchange detection unit 260 which is provided on the head unit 32 detects that the exchanging of the print head 35 is possible, the exchange notification unit 270 notifies the exchanging worker (the user) of the fact that the exchanging of the print head 35 is possible (step S430).

In this manner, by including a step of detecting the fact that the exchanging of the print head 35 is possible in the exchange detection unit 260 which is provided on the head unit 32, it is possible to precisely detect that the exchanging of the print head 35 is possible. Accordingly, it is possible to more reliably perform the exchanging work of the print head 35.

1.9 Operations and Effects

As described above, in the liquid discharging apparatus 1 according to the present embodiment, the exchangeable print head 35 and the wiring substrate 33 including the exchange detection unit 260 which detects that the exchanging of the print head 35 is possible are provided on the head unit 32. Accordingly, the exchange detection unit 260 is capable of detecting that the exchanging of the exchanging target print head 35 is possible in the vicinity of the print head 35. Therefore, the exchange detection unit 260 is capable of precisely detecting that the exchanging of the print head 35 is possible. Accordingly, it is possible to more reliably perform the exchanging work of the print head 35.

In the liquid discharging apparatus 1 according to the present embodiment, the exchanging target print head 35 and the cable 75 which transfers the drive signals COM-A1 to COM-An and COM-B1 to COM-Bn to the print head 35 are electrically connected via the wiring substrate 33. Furthermore, the print head 35 and the wiring substrate 33 are electrically connected by the B-to-B connector 77. Therefore, the drive signals COM-A1 to COM-An and COM-B1 to COM-Bn which are transferred by the cable 75 are input to the print head 35 via the wiring substrate 33 and the B-to-B connector 77 which is provided on the wiring substrate 33. The print head 35 and the cable 75 which transfers the drive signals COM-A1 to COM-An and COM-B1 to COM-Bn can be more easily attached and detached due to the B-to-B connector 77 which is provided on the wiring substrate 33. In this manner, by connecting the cable 75 to the wiring substrate 33 and connecting the wiring substrate 33 and the print head 35 to each other using the B-to-B connector 77, the print head 35 can be more easily attached and detached due to the B-to-B connector 77 which is provided on the wiring substrate 33 regardless of the number, structure, and the like of the cables over which the drive signals COM-A1 to COM-An and COM-B1 to COM-Bn are transferred. Accordingly, it is possible to easily perform the exchanging work of the print head 35.

In the liquid discharging apparatus 1 according to the present embodiment, the exchange detection unit 260 is provided on the wiring substrate 33 which is provided with the B-to-B connector 77 that is capable of attaching and detaching with respect to the print head 35. Accordingly, since the exchange detection unit 260 is capable of detecting that the exchanging of the print head 35 is possible in the vicinity of the B-to-B connector 77 which electrically connects the exchangeable print head 35 to the wiring substrate 33, it is possible to more precisely perform the detection. Accordingly, it is possible to more reliably perform the exchanging work of the print head 35.

In the liquid discharging apparatus 1 according to the present embodiment, the exchange detection unit 260 is provided on the wiring substrate 33 which is provided with the B-to-B connector 77 that is capable of attaching and detaching with respect to the print head 35. In other words, the exchange detection unit 260 is not provided on the exchanging target print head 35. Therefore, it is possible to reduce an increase in the number of components of the print head 35 to be exchanged and to further reduce the complication of the configuration of the exchanging target print head 35. Accordingly, the possibility that the ease of the exchanging work of the print head 35 will be impaired is reduced.

In the liquid discharging apparatus 1 according to the present embodiment, the plurality of voltage signals Vh (Vh1 to Vhn) is transferred via the cable 75 to the head unit 32 which includes the print head 35 and the wiring substrate 33. The exchange detection unit 260 detects that the print head 35 is exchangeable based on a signal which is obtained by combining the plurality of voltage signals Vh (Vh1 to Vhn) that is input. For example, when the signal which is obtained by combining the plurality of voltage signals Vh (Vh1 to Vhn) that is input is less than or equal to a predetermined value, the exchange detection unit 260 detects that the exchanging of the print head 35 is possible, indicating that the plurality of voltage signals Vh (Vh1 to Vhn) that is supplied to the print head 35 is less than or equal to the predetermined value. Accordingly, even in a case in which the plurality of voltage signals Vh (Vh1 to Vhn) is supplied to the print head 35, it is possible to reduce an increase in the scale of the exchange detection unit 260 and to reduce problems that are caused by a residual voltage (a charge) in the cables 75 and 76 and the print head 35 during the exchanging work of the print head 35. Accordingly, even in the print head 35 to which the plurality of voltage signals Vh (Vh1 to Vhn) is supplied, it is possible to reduce an increase in the circuit scale of the exchange detection unit 260 and to more reliably perform the exchanging work of the print head 35.

In the liquid discharging apparatus 1 according to the present embodiment, by providing the notification unit (the exchange notification unit 270) which performs notification of the fact that the exchange detection unit 260 detects that the exchanging of the print head 35 is possible, the exchanging worker is capable of ascertaining that the exchanging of the print head 35 is possible. Accordingly, the exchanging work of the print head 35 becomes possible at a suitable timing and the ease of the exchanging work of the print head 35 is further improved.

At this time, the notification unit (the exchange notification unit 270) is the lighting and non-lighting (or dimming) of a light emitting element (the LED 271) and is capable of visually notifying the exchanging worker of the fact that the exchanging of the print head 35 is possible.

The light emitting element (the LED 271) which is the notification unit (the exchange notification unit 270) is provided on the wiring substrate 33 which is provided with the B-to-B connector 77 that is electrically connected to the print head 35 to be exchanged. Ordinarily, when exchanging the print head 35, the exchanging worker visually inspects the vicinity of the print head 35 to be exchanged and the B-to-B connector 77 which is connected to the print head 35 and performs the exchanging work. Therefore, by providing the light emitting element (the LED 271) on the wiring substrate 33 which includes the B-to-B connector 77 that is viewed by the exchanging worker, it is possible to efficiently notify the exchanging worker of the fact that the exchanging of the print head 35 is possible. Accordingly, the ease of the exchanging work of the print head 35 is further improved.

2. Second Embodiment

Hereinafter, a description will be given of the liquid discharging apparatus 1 of the second embodiment. In the liquid discharging apparatus 1 of the second embodiment, the description will mainly be given of the content that differs from in the first embodiment and the description of the content which is duplicated with respect to the first embodiment will be omitted. In the liquid discharging apparatus 1 of the second embodiment, the description will be performed giving the configuration elements that are the same as in the liquid discharging apparatus 1 of the first embodiment the same reference numerals.

The circuit configuration of the exchange detection unit 260 and the exchange notification unit 270 in the liquid discharging apparatus 1 of the second embodiment differs from that of the first embodiment.

The configuration of the liquid discharging apparatus 1 of the second embodiment is the same as in the first embodiment and the description and the depiction thereof will be omitted (refer to FIGS. 1 and 2). The electrical configuration of the liquid discharging apparatus 1 of the second embodiment is the same as in the first embodiment and the description and the depiction thereof will be omitted (refer to FIG. 3). The configuration of the discharge unit 600, the configuration of the drive signal Vout, and the configuration of the selection unit 230 of the liquid discharging apparatus 1 of the second embodiment are the same as in the first embodiment and the description and the depiction thereof will be omitted (refer to FIGS. 4 to 10). The configurations of the liquid discharging unit 2 and the head unit 32 of the second embodiment are the same as in the first embodiment and the description and the depiction thereof will be omitted (refer to FIGS. 11 to 13).

Figure 16:
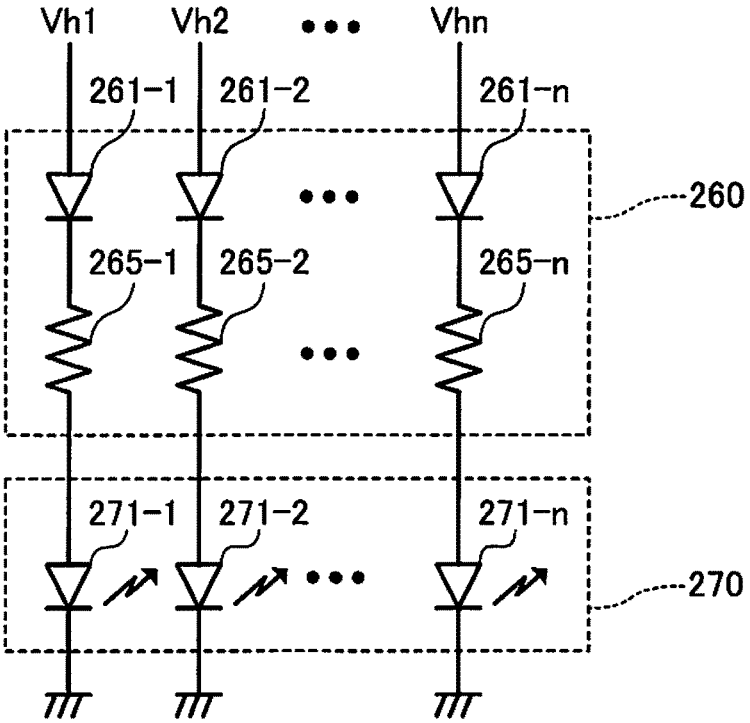
FIG. 16 is a diagram illustrating an example of a detection circuit and a notification unit of a second embodiment.

FIG. 16 is a circuit diagram illustrating the configurations of the exchange detection unit 260 and the exchange notification unit 270 in the second embodiment.

Even in the second embodiment, in the same manner as in the first embodiment, the exchange detection unit 260 detects that the exchanging is possible by detecting the conducting state to the print head 35 based on the plurality of (n) voltage signals Vh1 to Vhn which are output from the drive circuit unit 37.

The exchange detection unit 260 of the second embodiment includes the plurality of (n) diodes 261-1 to **261-*n* and a plurality of (n) resistances 265-1 to 265-*n***.

The plurality of (n) voltage signals Vh1 to Vhn are input to the anodes of each of the plurality of (n) diodes 261-1 to **261-*n*. Each of the plurality of (n) diodes 261-1 to 261-*n* is connected to one end of each of the plurality of (n) resistances 265-1 to 265-*n*. The other ends of the plurality of (n) resistances 265-1 to 265-*n* are output from the exchange detection unit 260**.

The exchange notification unit 270 of the second embodiment includes a plurality of (n) LEDs 271-1 to **271-*n*. The anodes of the plurality of (n) LEDs 271-1 to 271-*n* are connected to the output (the other ends of the plurality of (n) resistances 265-1 to 265-*n*) of the exchange detection unit 260, and the cathodes of the plurality of (n) LEDs 271-1 to 271-*n*** are connected to the ground potential.

In other words, in the exchange detection unit 260 and the exchange notification unit 270 in the second embodiment, the plurality of (n) diodes 261-1 to **261-*n*, the plurality of (n) resistances 265-1 to 265-*n*, and the plurality of (n) LEDs 271-1 to 271-*n* are connected in series to the plurality of (n) voltage signals Vh1** to Vhn, respectively.

The plurality of (n) resistances 265-1 to **265-*n* observes whether the conducting to the print head 35 stops with respect to the plurality of (n) voltage signals Vh1 to Vhn, respectively, and when the conducting to the print head 35 stops based on all of the plurality of (n) voltage signals Vh1 to Vhn, it is detected that the exchanging of the print head 35** is possible.

The plurality of (n) LEDs 271-1 to **271-*n* perform the notification of whether or not the conducting to the print head 35 stops with respect to the plurality of (n) voltage signals Vh1 to Vhn, respectively. For example, when the conducting to the print head 35 stops for all of the plurality of (n) voltage signals Vh1 to Vhn, the notification that the exchanging of the print head 35** is possible is performed.

In this manner, in the liquid discharging apparatus 1 of the second embodiment, it is possible to detect that the exchanging of the print head 35 is possible with respect to each of the plurality of (n) voltage signals Vh1 to Vhn that are supplied to the print head 35 in the exchange detection unit 260. Accordingly, it is possible to ascertain whether the exchanging of the print head 35 is possible for every one of the plurality of (n) voltage signals Vh1 to Vhn that is transferred to the print head 35. Accordingly, the exchange detection unit 260 is capable of detecting that the exchanging of the print head 35 is possible with even higher precision. Accordingly, it is possible to more reliably perform the exchanging work of the print head 35.

In the liquid discharging apparatus 1 of the second embodiment, since it is possible to detect a signal which is based on the plurality of (n) voltage signals Vh1 to Vhn that is transferred to the print head 35, it is possible to adapt to the detection of connection faults during the attachment work of the print head 35. Accordingly, it is possible to more reliably perform the exchanging work of the print head 35.

3. Modification Example

In the embodiments, a piezo-system liquid discharging apparatus in which drive circuits drive piezoelectric elements (capacitive loads) as the drive elements is exemplified. However, the invention can also be applied to a liquid discharging apparatus which drive elements other than capacitive loads are driven by the drive circuits. As the liquid discharging apparatus, for example, a thermal system (a bubble system) liquid discharging apparatus or the like in which the drive circuits drive the heat generating elements (for example, resistances) that serve as the drive elements and bubbles which are generated by the heat generating elements being heated are used to discharge the liquid (the ink) is exemplified.

Hereinabove, although a description is given of embodiments and modification examples, the invention is not limited to the embodiments or the modification examples and it is possible to implement various embodiments of the invention as long as the gist of the invention is not departed from. For example, it is also possible to combine the embodiments and the modification examples, as appropriate.

The invention includes configurations which are the substantially the same as the configurations described in the embodiments (for example, configurations having the same function, method, and results, or configurations having the same purpose and effect). The invention includes configurations in which non-essential parts of the configurations described in the embodiments are replaced. The invention includes configurations exhibiting the same operations and effects as the configurations described in the embodiments or configurations capable of achieving the same purpose. The invention includes configurations in which known techniques are added to the configurations described in the embodiments.

What is claimed is:

1. A liquid discharging apparatus configured to perform printing on a medium having a short-side width of A3 or greater, the apparatus comprising:

a head unit which includes an exchangeable print head including a discharge unit that discharges a liquid through driving of a drive element, a detection circuit which detects that exchanging of the print head is possible, a wiring substrate which is electrically connected to the print head; and a first connector via which the wiring substrate is electrically connected to the print head, the first connector being disposed on a surface of the wiring substrate and detachably coupled to the print head;

a drive circuit which outputs a drive signal for driving the drive element; and a cable which is connected to the wiring substrate and transfers the drive signal to the print head.

2. The liquid discharging apparatus according to claim 1, wherein the detection circuit is provided on the wiring substrate.

3. The liquid discharging apparatus according to claim 1, wherein the cable transfers a power voltage signal to the head unit, and wherein the detection circuit detects that the exchanging of the print head is possible, based on the power voltage signal.

4. The liquid discharging apparatus according to claim 3, wherein the cable transfers a plurality of the power voltage signals to the head unit, and wherein the detection circuit detects that the exchanging of the print head is possible, based on a signal which is obtained by combining the plurality of power voltage signals.

5. The liquid discharging apparatus according to claim 3, wherein the cable transfers a plurality of the power voltage signals to the head unit, and wherein the detection circuit detects that the exchanging of the print head is possible, based on each of the plurality of power voltage signals.

6. The liquid discharging apparatus according to claim 1, further comprising:

a notification unit which performs notification of whether or not the exchanging of the print head is possible, based on a result that is detected by the detection circuit.

7. The liquid discharging apparatus according to claim 6, wherein the notification unit includes a light emitting element which is provided to be visually recognizable.

8. The liquid discharging apparatus according to claim 7, wherein the light emitting element is provided on the wiring substrate.

9. The liquid discharging apparatus according to claim 1, wherein the cable has a first end that is connected to the wiring substrate via a second connector, which is different from the first connector, and a second end that is different from the first end and is connected to the drive circuit via a third connector different from the first and second connectors.

10. The liquid discharging apparatus according to claim 1, wherein the detection circuit is movable together with the print head with respect to the medium.

11. A method of detecting that exchanging of a print head is possible in a liquid discharging apparatus which performs printing on a medium having a short-side width of A3 or greater and which has a head unit which includes an exchangeable print head including a discharge unit that discharges a liquid through driving of a drive element, a detection circuit, a wiring substrate that is electrically connected to the print head, and a connector via which the wiring substrate is electrically connected to the print head, the connector being disposed on a surface of the wiring substrate and detachably coupled to the print head;

a drive circuit which outputs a drive signal for driving the drive element, and a cable which transfers the drive signal, the method comprising:

causing the detection circuit to detect that the exchanging of the print head is possible.

* * * * *